US011519233B2

(12) United States Patent
Hilliard et al.

(10) Patent No.: US 11,519,233 B2
(45) Date of Patent: Dec. 6, 2022

(54) VALVE ASSEMBLY

(71) Applicant: DRILLTOOLS LIMITED, Edinburgh (GB)

(72) Inventors: Ronald Paul Hilliard, Edinburgh (GB); Jeffrey Paul Knight, Inverurie (GB)

(73) Assignee: DRILLTOOLS LIMITED, Edinburgh (GB)

( * ) Notice: Subject to any disclaimer, the term of this patent is extended or adjusted under 35 U.S.C. 154(b) by 320 days.

(21) Appl. No.: 15/778,515

(22) PCT Filed: Dec. 1, 2016

(86) PCT No.: PCT/GB2016/053787
§ 371 (c)(1),
(2) Date: May 23, 2018

(87) PCT Pub. No.: WO2017/093745
PCT Pub. Date: Jun. 8, 2017

(65) Prior Publication Data

US 2018/0347301 A1 Dec. 6, 2018

(30) Foreign Application Priority Data

Dec. 3, 2015 (GB) ..... 1521341

(51) Int. Cl.
*E21B 21/10* (2006.01)
*E21B 41/00* (2006.01)
*E21B 34/10* (2006.01)

(52) U.S. Cl.
CPC ..... *E21B 21/10* (2013.01); *E21B 34/10* (2013.01); *E21B 41/00* (2013.01); *E21B 2200/05* (2020.05)

(58) Field of Classification Search
CPC ..... E21B 21/10; E21B 34/10; E21B 41/00; E21B 2034/005
See application file for complete search history.

(56) References Cited

U.S. PATENT DOCUMENTS 3,016,914 A * 1/1962 Keithahn ..... E21B 21/10 137/515
4,248,264 A * 2/1981 Hadsell ..... E21B 21/106 137/454.2

(Continued)

OTHER PUBLICATIONS

Int'l Search Report & Written Opinion (PCT/GB2016/053787), dated Apr. 18, 2017.
GB Search Report (GB1521341.6), dated Jan. 4, 2016.

*Primary Examiner* — Robert E Fuller
*Assistant Examiner* — Neel Girish Patel
(74) *Attorney, Agent, or Firm* — Hunton Andrews Kurth, LLP

(57) ABSTRACT

A valve assembly (1) has a valve (14), for example a flapper valve, that is contained within an axially movable valve housing (11) in the form of a cartridge (10) that is received within the bore of a tubular member (5). More than one cartridge (10) may be connected in series. The valve (14) and cartridge (10) are pivotally connected (13) and axial movement of the cartridge (10) pivots the valve (14) around this connection (13) to open or close the valve (14). The valve assembly (1) can be actuated by an actuator assembly (50) having an actuator (61) for actuating the valve (14), and a resettable shuttle device (80) that retains the actuator (61) in different configurations within the actuator assembly (50). The actuator (61) can be moved relative to the valve (14), engaging the shuttle device (80) and changing the configuration of the shuttle device (80).

25 Claims, 20 Drawing Sheets

(56) References Cited

U.S. PATENT DOCUMENTS 4,531,587 A * 7/1985 Fineberg ..... E21B 34/10 166/332.8
5,564,675 A 10/1996 Hill, Jr. et al.
6,253,843 B1 * 7/2001 Rawson ..... E21B 34/066 166/66.7
8,978,775 B2 * 3/2015 Lindsay ..... E21B 34/08 166/373
2005/0039922 A1 * 2/2005 Vick ..... E21B 34/06 166/332.8
2006/0011354 A1 * 1/2006 Logiudice ..... E21B 21/103 166/380
2006/0169465 A1 * 8/2006 Hejl ..... E21B 34/12 166/386
2006/0196675 A1 9/2006 Patel et al.
2006/0272824 A1 12/2006 Adams
2008/0035353 A1 * 2/2008 Hughes ..... E21B 34/06 166/386
2009/0056952 A1 * 3/2009 Churchill ..... E21B 34/14 166/373
2009/0071654 A1 * 3/2009 O'Malley ..... E21B 34/105 166/323
2010/0108324 A1 * 5/2010 Tanju ..... E21B 23/00 166/373
2010/0264346 A1 * 10/2010 Bussear ..... F16K 31/043 251/250.5
2011/0088908 A1 * 4/2011 Xu ..... E21B 34/10 166/332.8
2011/0120773 A1 * 5/2011 Hilliard ..... E21B 21/103 175/57
2011/0155381 A1 * 6/2011 Reaux ..... E21B 34/10 166/334.1
2012/0305257 A1 * 12/2012 Conner ..... E21B 21/10 166/323
2013/0020089 A1 * 1/2013 Xu ..... E21B 34/102 166/373
2013/0068476 A1 3/2013 Edwards
2014/0034325 A1 * 2/2014 Jancha ..... E21B 34/12 166/321
2014/0124212 A1 * 5/2014 Slup ..... E21B 21/10 166/373
2014/0144642 A1 * 5/2014 Lindsay ..... E21B 43/26 166/308.1
2015/0068763 A1 * 3/2015 Jepp ..... E21B 41/00 166/373
2015/0147495 A1 * 5/2015 Kumar ..... E21B 17/10 428/34.1
2015/0330186 A1 * 11/2015 Budde ..... E21B 34/12 166/373
2016/0222757 A1 * 8/2016 Brimer ..... E21B 34/06
2016/0341002 A1 * 11/2016 McKitrick, III ..... E21B 34/14
2017/0114942 A1 * 4/2017 McLaughlin ..... F16L 15/008
2017/0321494 A1 * 11/2017 McLaughlin ..... E21B 17/042

* cited by examiner

VALVE ASSEMBLY

The present invention relates to apparatus and a method relating to a valve assembly and a method of controlling flow in an oil or gas well.

BACKGROUND OF THE INVENTION

Non-return valves (NRVs) are known in the art to control fluid flow in a conduit, permitting fluid flow in one direction, and restricting or preventing it in another direction. NRVs are used in oil and gas well conduits for preventing backflow of drilling mud up an oil or gas wellbore or drill string.

NRVs are frequently in the form of flapper valves comprising a pivot pin positioned in a hole drilled through a pivot tongue in the valve body, with a torsion spring wrapped around the pivot pin to offer some resilience in the flapper movement.

SUMMARY OF THE INVENTION

According to the present invention, there is provided a valve assembly for controlling fluid flow in a throughbore of a wellbore conduit of an oil, gas or water well, the assembly comprising a body having an axis and being in fluid communication with the wellbore conduit, and at least one valve comprising a valve member disposed in a valve housing in the body, wherein the valve housing is adapted to move axially within the body, and including a displacement mechanism adapted to urge the valve housing axially within the body, wherein the valve member is adapted to be actuated between an open configuration and a closed configuration by axial movement of the valve housing within the body, and wherein the valve is adapted to be opened by a pressure differential, arising from flow of fluid in the throughbore in an uphole to downhole direction, acting across the valve.

The present invention further provides a method of control of fluid flow in a throughbore of a wellbore conduit of an oil, gas or water well, the method including flowing the fluid through a valve disposed in a body being in fluid communication with the wellbore conduit, the valve comprising at least one valve member disposed in a valve housing, wherein the housing is axially movable with respect to the body, and wherein a displacement mechanism is configured to urge the valve housing to move in an axial direction with respect to the body, wherein axial movement of the housing with respect to the body actuates the valve member between an open configuration and a closed configuration, and wherein the valve is adapted to be opened by a pressure differential, arising from flow of fluid in the throughbore in an uphole to downhole direction, acting across the valve.

Optionally a single valve is disposed in the body, although in other examples multiple valve assemblies, for example 2, 3, 4 or more valves can be disposed in the body, optionally in series with one another, and arranged in axial alignment with one another and with a bore of the body.

Optionally the valve is a non-return valve or check valve. Optionally the valve member is a flapper and the valve is a flapper valve. Optionally the valve member is biased towards a closed configuration, denying or restricting fluid flow through the body, optionally through a bore in the valve housing.

Optionally the housing and valve member form a valve cartridge that is received within the bore of the body, and which is removable from the bore of the body. Optionally two or more valve cartridges are connected in series in axial alignment with the bore of the body. Optionally each valve cartridge is modular and individually removable from other cartridges placed in series downhole from the cartridge to be removed. Optionally each valve cartridge comprises a valve housing and a valve member.

Optionally a seal is provided between each valve housing and the body, preventing or restricting the passage of fluid past the valve housing, and diverting fluid through the bore of the valve. Optionally the seal is compressed between the valve housing and the body, optionally in an annular recess in one of the valve housing and the body, and is adapted to seal the annulus between the valve housing and the body during the axial movement of the valve housing within the body. Optionally the seal can be an annular seal, and can be an elastomeric or resilient seal, such as an o-ring, retained in an annular groove, which is optionally located in the valve housing.

Optionally the valve member closes the bore of the body, optionally by closing a bore through the valve housing, when the valve is in the closed configuration. Optionally the valve contains ports adapted to prevent high levels of backflow while, for example, still permitting monitoring of pressures in the body below the valve.

Optionally at least one of the faces of the valve member is of arcuate construction, such that when the valve assembly is in an open configuration, a first (outer) face of the valve member is formed in an arc extending around the axis of the bore and optionally conforms with the inner diameter of the body. Optionally in the open configuration a second (inner) face of the valve member is formed in an arc extending around the axis of the bore, and optionally conforms with the inner surface of the valve housing.

The axis of the body is optionally concentric with the wellbore axis, but non-concentric examples can be made.

Optionally the valve is centralised within the bore of the body, and the assembly can optionally incorporate at least one centralising sleeve for this purpose. Optionally the bore through the housing is centralised in axial alignment with the bore of the body. Optionally the centralising sleeve has a bore adapted to receive a part of the valve housing, optionally at one end of the valve housing, for example, the lower end of the valve housing, and is adapted to maintain the valve housing in a centralised configuration within the body. Optionally the centralising sleeve can be disposed between an end of the valve housing and an end of the displacement mechanism.

Optionally the valve member and valve housing are connected by a pivot that is optionally integral to one of the valve member and the housing. Optionally the pivot comprises a pivot axle on one of the valve housing and the valve member, and an axle-receiving recess on the other. Optionally the valve member is pivotally coupled to the valve housing by a pivot axle formed as an integral part of one of the valve housing and the valve member. Optionally the integral pivot axle comprises a pair of cylindrical protrusions extending from opposing surfaces of one of the valve housing and the valve member and the axle is received within a recess in the form of a groove formed in the other of the valve housing and the valve member. Optionally the pivot axle forms an integral part of the valve member and is received within a groove formed in the valve housing.

Optionally the displacement mechanism comprises a resilient device, such as a compressive resilient device. Optionally the displacement mechanism comprises a tensive resilient device. A non-exhaustive list of examples may include a compression spring; a gas spring; a compressible fluid; a hydraulic device having a resilient function; a wave spring; a Belleville spring; and an extension spring. Optionally the displacement mechanism does not need to be resilient, and can be provided by a hydraulic mechanism.

Optionally a long spring is used with lower resistance to compression. Optionally a short spring is used with high resistance to compression. Optionally the length and strength of the spring can be chosen to suit the applications for which the apparatus will be used, and can be varied in different examples of the invention. Accordingly the spring can be designed to have different strengths (and optionally much higher strengths than was previously possible) without compromising the design of the valve.

Optionally the displacement mechanism is radially spaced from the throughbore of the body. Optionally, at least a portion of the displacement mechanism is disposed outside of the fluid flowpath. Optionally the displacement mechanism forms a bore with an axis, optionally in line with the axis of the bore of the valve assembly. Optionally the displacement mechanism is axially spaced from the valve housing. Optionally the displacement mechanism is axially aligned with the valve housing, and optionally is arranged in compression between the valve housing and a formation in the bore of the body, to urge the valve housing axially within the bore of the body.

Optionally the displacement mechanism is configured to urge the valve member into the closed configuration, optionally when backflow is low (for example, low pressure flow from downhole to uphole). Optionally, the positioning of the displacement mechanism allows a greater closing force to be applied to the valve member in order to close the valve in a low backflow environment. Optionally the spring urges the valve member onto the seat as soon as the force of the pressure differential acting to open the flapper reduces below the force of the spring acting to close it, i.e. when pumps are switched off from the surface.

Optionally the valve assembly comprises a seal. Optionally the seal can be bonded to one of the valve member and the housing. Optionally the seal can be arranged to seal (optionally in compression) between the valve housing and the valve member.

Optionally the seal is protected from the fluid flowpath, for example, by being disposed above or below a shoulder or restriction in the bore of the valve housing, and can optionally be recessed in a groove of the valve housing e.g. below the shoulder. Optionally the groove is disposed on a tapered face of the valve, optionally downhole from a narrowed throat of the valve. Optionally the seal is disposed on the seat of the valve housing (it could optionally be disposed on the surface of the valve member instead or as well), and is adapted to be compressed between the seat of the valve housing and the valve member when the valve is closed. Optionally the seat faces downhole in the valve housing. Optionally the seal is an annular seal and can comprise a resilient annular ring optionally formed from plastic or rubber material, which can be bonded to a component of the valve assembly, for example to the seat in the housing. Other sealing materials can be used.

Optionally the seating surfaces of the valve member and the housing which engage when the valve member is seated on the housing incorporate metal sealing surfaces, which can be machined, ground or polished to form high pressure seals. Optionally the seating surfaces together form a metal to metal seal. Optionally the seating faces include a resilient seal, optionally bonded to the seating surface of one of the valve member and the housing, and optionally bonded in a groove therein. Optionally the resilient seal can be compressed between the seating faces of the flapper and the housing to provide a low pressure seal, before the seating faces of the flapper and the housing engage. Optionally at higher pressures, the resilient seal is compressed into the groove, and the metal seating faces of the flapper and the housing engage and seal together to provide a higher pressure metal to metal seal.

Optionally fluid flows through the body and optionally through the valve housing (e.g. through the bore of the valve housing) in one direction (optionally downwards through the body, from the uphole side of the valve assembly above the valve assembly to the downhole side below the valve assembly) when the valve is open, and is prevented from flowing in the opposite direction (optionally from downhole to uphole) by the closure of the valve member in the valve housing. The valve thus opens initially in response to flow in a downwards direction. The valve is adapted to be opened and closed by pressure differentials acting across the valve without requiring external actuation of the valve. Optionally the valve assembly seals from the downhole direction only. The valve opens by differential pressure (flow) from above the valve. The valve is optionally closed by the resilient device when there is no flow from above and once closed any additional pressure from below further enhances the pressure sealing capability from below.

Optionally the valve assembly has a radial restriction extending radially into the bore of the housing, so that the valve assembly comprises at least two cross-sectional areas, which optionally together act as a nozzle to create a pressure differential during flow through the housing such that there is a higher pressure on one side of the valve member relative to the other side. Thus the valve assembly optionally comprises a nozzle on a sleeve adapted to slide axially in the bore in response to pressure differentials across the nozzle. Optionally the cross-sectional areas are positioned such that when fluid flows in the bore, the valve member experiences high fluid pressure on its uphole surface and low fluid pressure on its downhole surface. Optionally this pressure differential actuates the valve member between the open and closed configurations. The pressure differential arising from flow of fluid in the bore above the valve urges the flapper to open it partially. The pressure differential also acts on the top side of the seal on the housing, urging it axially within the bore. As the pressure differential across the valve rises the housing is urged axially in a downhole direction within the body against the force of the spring. This axial movement of the housing allows the flapper to open further. When flow ceases, the pressure above and below the valve will equalise as the flapper is momentarily still open, but the spring will then urge the housing and flapper axially upwards to close the flapper against the seat.

Optionally the larger of the cross-sectional areas is sealed, optionally by an annular seal, which may be resilient, such as an o-ring. Optionally another cross-sectional area is provided by a bore extending through the housing, optionally by a valve seat against which the valve member is adapted to seat during closure of the valve. The pressure differential is optionally created by the restriction of fluid flow through the housing when the valve is at least partially open.

Optionally the valve assembly includes a valve control member adapted to limit the axial movement of the valve housing within the body. Optionally the valve control member permits limited axial movement of the valve housing within the body, retains the valve housing within the body and restricts movement of the valve housing to a limited range. Optionally the valve control member selectively engages the valve member and controls its movement relative to the valve housing. Optionally at least a part of the valve control member extends radially into the bore of the body to engage a portion of the valve cartridge (e.g. the valve housing) and resist or limit its axial movement in the body. Optionally radial protrusion of the valve control member into the bore of the body can extend circumferentially around at least a part of a circumference of the body. Optionally the valve control member extends circumferentially around only a part of the valve assembly, and can be circumferentially discontinuous. Optionally the valve control member can be disposed in recess in the body, for example, a recess formed in the inner surface of the bore of the body, which can allow limited axial movement of the valve control member in the body, and which defines the limits of axial movement of the valve control member within the body. Optionally the valve control member can be resiliently biased in relation to the body and/or the valve cartridge. Optionally the valve control member can comprise an activation ring optionally in the form of a c-ring or split ring, but other forms of valve control member are not excluded. Optionally valve assembly has a circumferential groove adapted to receive the activation ring. Optionally the valve assembly includes a spline, tang, ridge, or other obstruction to maintain the rotational positioning of the activation ring within appropriate ranges. Optionally the activation ring is fixed in rotational position within the valve assembly relative to the valve member. Optionally the range of axial movement of the valve control member is limited by a shoulder on the body. Optionally the valve control member can move axially away from the shoulder, optionally down the hole, but cannot pass the shoulder. Optionally the valve control member is disposed below the shoulder and cannot pass above it. Optionally the shoulder faces the downhole end of the valve assembly and therefore limits the upward movement of the valve control member when it is engaged with the shoulder below the shoulder. Optionally the valve control member is disposed between the valve member and the shoulder, and is urged towards and/or against the shoulder by the force of the displacement mechanism urging the valve in an upward direction.

Optionally the axial travel of the valve assembly (e.g. the valve housing or the cartridge) in the bore can be limited by a travel stop, which can optionally comprise a shoulder extending radially into the bore, or a sleeve or other component bearing against a shoulder or end face of a body component.

Optionally the valve can be opened by fluid pressure, and can optionally be passively opened by fluid pressure alone. Optionally the valve member is adapted to open as the valve assembly is urged axially within the body by the fluid pressure. Optionally the force of the fluid pressure acts in opposition to an axial force applied to the valve assembly by the displacement mechanism, and optionally must overcome this before movement of the valve cartridge in the body is possible. Optionally the axial movement of the valve housing in the body moves the valve member relative to the valve control member and permits the valve member to pivot into the open configuration. Optionally at least a part of the valve member is always in contact with the valve control member. For example, when the valve housing moves axially, a portion of a tang on the valve member optionally remains in contact with the valve control member as it revolves around the pivot axle. While the valve member is engaged with the valve control member, as is the case prior to axial movement of the housing, the valve member is optionally not free to pivot and remains in the closed configuration.

Optionally when exposed to sufficient fluid pressure above the valve assembly, the valve member moves between the open and closed configurations. When flow reduces the valve member optionally returns to the closed configuration. Optionally, the flow rate required to maintain the valve member in the open configuration can be varied according to the strength of the displacement mechanism.

Optionally there is an offset between the point of contact between the valve member and the valve control member, and the pivot axis of the valve member, such that optionally when the valve member is moving from the open configuration to the closed configuration the valve member may abut against the valve control member in order to initiate closing of the valve member around the pivot axis as the housing slides axially relative to the valve control member. Optionally the offset comprises a radial offset, whereby inter-engaging portions of the valve control member and valve member are radially spaced from the pivot axis of the valve member. Optionally the portion of the valve control member is spaced at a greater radial distance from the axis than the portion of the valve member. Hence, when the axially-moving valve member engages the axially-static valve control member, the valve member is urged between the open and closed configurations, for example, from the open configuration to the closed configuration. Optionally the valve control member assists in maintaining the valve member in the closed configuration.

Optionally offset portion of the valve member (e.g. the flapper) comprises a tang which engages the valve control member (i.e. the activation ring). The tang and the plate extend away from the pivot axis of the flapper in opposite directions (e.g. opposite radial direction when the flapper is closed on the seat, and opposite axial directions when the flapper is open).

Optionally a flat face on the valve member engages a flat face on the valve control member in both of the open and closed configurations. There are optionally two flat faces on the valve member and optionally on the control member, and optionally the angular deviation between the two flat faces on each are equal to the angular deviations between the open and the closed configurations of the valve, i.e. in this example, perpendicular. The flat faces are optionally connected by a rounded corner on at least one of the valve member and the valve control member, and optionally on both. On the valve member, e.g. the flapper, the flat faces are on the tang, Thus, in the closed configuration, when the valve member is perpendicular to the axis of the body, the flat lower face on the underside of the valve control member (e.g. the activation ring) engages a first flat upper face on the offset tang of the valve member, thereby maintaining stability of the valve member in the closed position, with the resilient spring of the displacement mechanism pushing the flat face on the tang of the valve member against the flat lower face of the underside of the valve control member (e.g. the activation ring). During opening of the valve, when the valve member is pivoting around the pivot axis, the offset tang of the valve member remains in contact with the flat lower face on the underside of the valve control member as the contact point between the valve member and the valve control member tracks around the rounded corner between the first and second flat faces of the tang, until the valve member reaches the open configuration, at which point the second flat face on the tang, which is perpendicular to the first flat face, is disposed flat against the flat lower face on the underside of the valve control member. Thus, in the open configuration the valve member and the valve control member engage one another with flat surfaces. The transition between the closed and open configuration involves a tipping point as the contact point between the valve member and the valve control member tracks around the rounded corner between the perpendicular flat surfaces on the valve member, so that as the halfway point at the rounded corner is reached and passed, the remaining travel to the open configuration or the closed configuration is accomplished quickly, aided by the axial force applied by the resilient spring of the displacement mechanism. Thus, as the valve member passes the halfway point, achieves the open or closed configuration when the flat faces engage which holds the valve, e.g. in the open configuration in a stable manner resulting from inter-engagement of the flat surfaces in open and closed configurations. The flat surfaces also reduce wear on the valve components by forcing the valve components to adopt more definite open and closed configurations, with reduced variation in relative positions, e.g. when the valve is open.

Optionally, fluid pressure acting on the valve member and actuating it between the open and closed configurations also urges axial movement of the housing. Optionally, the axial movement of the valve assembly acts to energise the displacement mechanism.

Optionally, during use in drilling operations, the valve assembly will automatically close in the event of back flow (from downhole to uphole) in the wellbore conduit.

According to the present invention, there is also provided a valve assembly for controlling fluid flow in a throughbore of a wellbore conduit of an oil, gas or water well, the assembly comprising a body having an axis and being in fluid communication with the wellbore conduit, a valve, and a valve control member for controlling the actuation status of the valve, wherein the valve is adapted to be actuated between an open configuration and a closed configuration by relative axial movement of the valve control member and at least a portion of the valve, and wherein the valve is adapted to be opened by a pressure differential, arising from flow of fluid in the throughbore in an uphole to downhole direction, acting across the valve.

The present invention also provides an actuator assembly for use in an oil, gas or water well, the actuator assembly being adapted to change an actuation status of a tool in the well, the actuator assembly comprising a body, an actuator member adapted to change configurations in the body to change an actuation status of the tool, and a shuttle device adapted to retain the actuator member in different configurations in the body, wherein the shuttle device is adapted to change configurations within the body relative to the actuator member, and has a detent mechanism adapted to engage the actuator member in a first configuration of the shuttle device and the actuator member to restrain movement of the actuator member within the body, and wherein in a second configuration of the shuttle device and the actuator member the detent mechanism permits movement of the actuator member within the body to actuate the tool, and wherein the shuttle device has a return mechanism adapted to urge the shuttle device into the first configuration.

According to the present invention, there is further provided a valve assembly as defined above having an actuator assembly as defined above, wherein the actuator assembly is adapted to change the actuation status of the valve assembly by movement (optionally axial movement) of the actuator member in relation to the valve member. However, the valve assembly can be used with other actuators independently of the actuator assembly, and the actuator assembly can be used with other devices independently of the valve assembly.

Optionally the return mechanism comprises a biasing mechanism.

Optionally the body has a bore providing a fluid flowpath through the body. Optionally the body of the actuator assembly can comprise a wellbore conduit, having a bore adapted to convey fluids. Optionally the body of the actuator assembly comprises a tool body adapted to connect into a string of tubulars in an oil or gas well, and having suitable connections at opposite ends, for example, box and pin connections for inter-connection into a string of tubulars.

Optionally the shuttle device is arranged to move axially within the body. Optionally, the shuttle device can move in other ways, for example, rotationally around the axis. Optionally the shuttle device can comprise an elongate member, optionally extending axially with respect to the body. The shuttle device can be in the form of a shuttle sleeve having a bore with an axis, configured to receive the actuator member within the bore of the shuttle sleeve. Optionally the shuttle device is contained within the body. Optionally the body comprises a portion of the wellbore conduit.

The actuator member can be in the form of an elongate member extending axially along the body, for example, in the form or a rod, or in one example, an actuating sleeve having a bore with an axis. The bore optionally permits the passage of fluid and well equipment, for example, well fluids, downhole tools, balls, etc. through the actuator member. Optionally, the bores of the shuttle sleeve and the actuating sleeve are co-axially positioned.

Optionally, the shuttle device radially surrounds at least a portion of the actuator member.

Optionally the return mechanism or biasing mechanism includes at least one resilient device optionally arranged to act on the shuttle device, optionally to urge the shuttle device axially within the bore of the housing. Optionally the at least one resilient device has an axis that is aligned with the axis of the shuttle device, and is arranged to act on an axially facing portion of the shuttle device. Optionally two resilient devices are provided and can be axially spaced. Optionally the two resilient devices are adapted to urge the shuttle device in axially opposing directions, optionally being adapted to be compressed between axially spaced portions of the shuttle device (optionally shoulders on the shuttle sleeve that have axially facing faces) and respective opposing shoulders in the housing. Optionally the shoulders in the housing face one another and the shoulders on the shuttle device are disposed between the shoulders on the housing. Optionally the forces applied to the shuttle device by the resilient devices are balanced. Optionally the forces acting in opposite directions maintain the shuttle device in a static configuration in the absence of other forces, optionally urging the shuttle device towards the first (resting and inactive) configuration. Optionally the housing radially surrounds the resilient devices. Optionally the resilient devices are preloaded and are maintained in compression.

The detent mechanism optionally comprises a collet device. The collet device optionally comprises at least one collet finger, optionally two, three, or more collet fingers, which can be resiliently connected by a cantilever connection to the shuttle sleeve. Optionally each collet finger has a distal end spaced from the cantilever connection with the shuttle sleeve. Optionally the distal end is capped by a polygonal head. Optionally the polygonal head an upper face disposed on the uphole side of the head (which is optionally radially extending) and facing the uphole end of the body, and inner and outer faces of the polygon, which are optionally parallel to the axis of the body. The upper face is connected to the inner and outer faces by angled side faces, optionally canted at angles to the axis below 90 degrees, and optionally extending in opposite directions, optionally at equal angles. Optionally, the inner and outer faces then connect to two corresponding downhole canted faces, which connect to an elongated strip forming the rest of the collet finger, which in turn connects to the shuttle sleeve by the cantilever connection. Optionally these faces together form a segmented ring of faces connected in series around each head in a circumferential arrangement around the head. Optionally the segmented ring of faces can have greater or fewer faces than herein described. Optionally the shape of the polygonal head can be adapted to correspond to differences in the shuttle device or the inner wall of the housing.

Optionally the natural resting position of the shuttle device is between the two resilient devices, which optionally engage annular spring sleeves that optionally surround at least a portion of the shuttle sleeve and are optionally urged axially towards one another by the resilient devices, which optionally transfer their load to the spring sleeves. Optionally in the natural resting position of the actuator assembly, the spring sleeves are urged by the resilient devices against a formation extending radially into the bore of the body, for example, an internal ridge in the body positioned between the resilient devices. The resilient devices are therefore optionally preloaded and maintained in compression in the natural resting position of the shuttle device. The spring strength and preload of the resilient devices can be adapted in different examples. In some examples, the preload of the two resilient devices can be balanced, but optionally in some examples, the preload of the lower resilient device can be different from the upper, and this is useful in order to set specific latching forces during running a component into the valve, or specific overpull forces during recovery of a component from the valve. Likewise the spring rate of the two springs can be the same, i.e. balanced, but in some cases it is advantageous to have different spring rates on the upper and lower spring sleeves. This allows the operator to set forces during running in and latching or pulling out of the hole. Optionally the natural resting position is arranged such that the polygonal head of each collet device is disposed radially inside of the internal ridge on the housing, and with the spring sleeves abutting upper and lower opposite sides of the ridge.

Optionally the spring sleeves engage axially spaced portions of the shuttle device. Optionally the shuttle device has a radially outwardly extending shoulder on each side of the collet head, and spaced away from the collet head, and each spring sleeve has a radially inwardly extending shoulder adapted to engage a respective shoulder on the shuttle device. The shoulders on the shuttle device are optionally disposed between the collet head and the shoulders on the spring sleeves. Optionally the shoulders are engaged when the collet head moves away from the ridge. Optionally the shoulders are engaged when the collet head is axially aligned with the ridge.

Optionally the actuator member passes through the bore of the shuttle device. Optionally the actuator member has at least one shoulder on the external surface of the actuator member. Optionally this shoulder engages with the detent mechanism (optionally with at least one collet device of the shuttle device) as the actuator member moves axially within the housing (optionally in a downhole direction).

Optionally, as the actuator member moves through the shuttle device, the engagement of the shoulder on the actuator member with the collet device urges the shuttle device in the same axial direction as the actuator member. Optionally as the shuttle device moves with the actuator member relative to the body, the collet device is released from the internal ridge on the body and can then expand in a radial direction away from the actuator member.

Optionally, the radial expansion of the collet finger releases the engagement of the polygonal head of the collet finger with the shoulder on the actuator member, allowing the actuator member to disengage from the shuttle device. Optionally, the same internal shoulder of the actuator member then engages with an inwardly-extending shoulder on the body internal to the bore, which optionally restricts or prevents any further axial movement of the actuator member in the downhole direction.

As the actuator member moves down the bore, the polygonal head of the detent mechanism optionally moves radially inward to enter an axially elongated recess in the external surface of the actuator member. Optionally, this recess extends in an axial direction, and can be annular, surrounding the actuator member. Radially inward movement of the head of the detent mechanism into the recess optionally permits the shuttle device to return to its natural position under the force of the resilient devices, engaging the internal ridge of the body. Optionally, once the shuttle device is again in its natural position, the head of the collet finger engages with the uphole edge of the recess to limit the movement of the shuttle device in the uphole direction, and to keep it engaged with the internal ridge. This keeps the detent mechanism engaged between the body, shuttle sleeve and actuator member, and maintains the position of these components while the collet head is in the recess in the actuator member.

Optionally the actuator member is retracted from the bore of the body, for example, when the tool is to be deactivated, for example, the valve is to be closed. Optionally the actuator member is manufactured with a fishing neck optionally in an uphole portion, optionally on an inner surface. Optionally retraction is achieved by a wireline fishing tool. Optionally the actuator member can be retracted by other mechanisms, for example, small diameter drillpipe, snubbing assembly, coring assembly, actuator rod etc.

Optionally, during retraction, the downhole edge of the axially elongated recess in the external surface of the actuator member engages the lower canted surfaces of the polygonal head of the collet device. Optionally the head of the collet device is pulled in an uphole direction by a shoulder of the recess (for example a lower shoulder facing the uphole direction) and brought out of engagement with the internal ridge of the housing. Optionally this allows the collet head to radially expand away from the actuator member and optionally to disengage from the recess in the actuator member. Optionally the resilient devices are energised as the shuttle device is pulled out of equilibrium at the first configuration. Optionally the expansion of the collet head and disengagement of the head from the recess on the actuator member allows the actuator member to move uphole relative to the shuttle device until the downhole-facing shoulder on the actuator member has travelled past the collet finger or fingers. Optionally when the external diameter of the actuator member reduces again below the recess the head of the collet can move radially inwards out of engagement with the upper surface of the internal ridge and the shuttle device can return to its natural position under the force of the resilient devices.

Optionally the actuator member can be used to hold the valve assembly in the open configuration in order to permit passage of, for example, wireline tools, coiled tubing tools, cables such as carbon fibre or wire, or balls through the valve.

Optionally, passage of the actuator member through the valve assembly moves the valve assembly axially. Optionally this axial movement of the valve assembly energises the valve displacement mechanism.

Optionally the actuator member acts to force the valve member to pivot around the pivot axis of the valve member as it is engaged by the valve control member and is thereby pivoted into the open configuration, optionally as the valve assembly is moving in an axial direction.

Optionally when the actuator member is retracted the valve assembly returns to its natural position in the first configuration under the force of the displacement mechanism. Optionally the valve member abuts against the valve control member and returns to a closed configuration.

Optionally the shuttle device is adapted to be reused several times before requiring maintenance, in contrast to shear pin assemblies which require removal and redressing between each use.

Optionally the valves have a downhole pressure rating in the range of 0-15 kpsi, and a possible working pressure range of approximately 4,000-25,000 psi.

Optionally the valve assembly is optimised for use in high pressure high temperature (HPHT) wells. Optionally the valve assembly is used as a drilling safety valve. Optionally in a surface application, a single valve assembly can be disposed at the bottom of a drill stand, from which a drillstring is suspended, allowing mud to be circulated for drilling while preventing backflow up the drillstring in the event of drillstring leak or failure. Positioning of the valve in this way permits connections at the surface to be made while downhole pressure is reliably held by the valve.

Optionally the valve has a working pressure rating of 14,000-16,000, eg. 15,000 psi, optionally in one or more of the following locations: from the downhole end of the valve assemblies; internally to the valve assemblies; external to internal of the valve assemblies. A working pressure rating of this magnitude allows the valve assembly (for example a flapper) to be run immediately below blow out preventers on a rig during drilling operations, if desired, without compromising the well control pressure rating of the well system.

Optionally the flapper valves have a pressure rating in the range of, for example, 5,000-10,000 psi.

Optionally the flapper valve has an external to internal working pressure rating of 7,000-8,000 psi suitable for use in a downhole environment in the bottom hole assembly. Optionally the flapper valve has a body working pressure rating in the range of 7,000-8,000 psi. Optionally the flapper valve is a solid valve with a working pressure rating, below the flapper, of 7,000-8,000 psi. Optionally the flapper valve contains ports to prevent high backflow but allow monitoring of pressures in the wellbore below the valve assembly.

The flapper valve is optionally designed in such a way that manual intervention is not necessarily required in the event that the valve must be closed, and hence drilling can occur with a stand of drillpipe using only one valve. Optionally a plurality of separate valve assemblies, optionally three valve assemblies, are run in a drillpipe triple, optionally with the well being drilled in triple lengths. Optionally a plurality of valve assemblies are run in a drillpipe double, optionally two valve assemblies, optionally with the well being drilled in double lengths. Alternatively, a single valve may be used per single stand of drillpipe, with the well being drilled in single joints.

Optionally the valve assembly, optionally in combination with the actuator assembly, forms part of a string, optionally a drill string. Optionally the valve assembly is run into the well as part of the string. Optionally when run in, the valves are in a closed configuration. It is known that pressure may get trapped below valves, which then requires bleeding off in a controlled manner to prevent the pressure below the valve rising to potentially damaging levels and/or in order that the string can be safely have a connection opened below the valve assembly.

Optionally conventional pressure control/bleed-off apparatus is placed above the string. Optionally wireline pressure control equipment is placed above the string. Optionally a lock-open sleeve as described above is connected to the end of the wireline. Optionally the lock-open sleeve, optionally connected to wireline, is placed within the bore of the actuator assembly after connection of the pressure control equipment to the string. Optionally once the pressure control equipment is connected, the parts of the string above the valve may be pressured up. Optionally the lock-open sleeve is run through the actuator and valve assemblies to actuate the valve or valves into the open configuration, thus releasing the trapped pressure and allowing it to be bled off. Once the pressure has been sufficiently reduced the lock-open sleeve may be withdrawn, allowing the valve or valves to close, thereby maintaining pressure integrity in the string below the valve or valves.

According to a further aspect of the present invention, there is provided a tubular comprising at least two body sections, the tubular further comprising a valve assembly for controlling fluid flow in a throughbore of a wellbore conduit of an oil, gas or water well, wherein the tubular has a first body section having an axis and being in fluid communication with the wellbore conduit, and at least one valve comprising a valve member disposed in a valve housing in the first body section, wherein the valve housing is adapted to move axially within the first body section, and including a displacement mechanism adapted to urge the valve housing axially within the first body section, wherein the valve member is adapted to be actuated between an open configuration and a closed configuration by axial movement of the valve housing within the first body section; wherein the first body section is connected to a second body section, wherein the first body section is separable from the second body section; and wherein the first and second body sections are axially spaced apart by at least one spacer device that is disposed between the end surfaces of the said first and second body sections.

Optionally the at least one spacer device may be adapted to space two or more body sections of the tubular axially from one another, for example, spacing one sub from another. Optionally the spacing devices are annular. Optionally the spacing devices are partially annular, for example semi-circular, for example half shells. Optionally one or more spacing devices can be positioned between body sections, optionally so that a complete ring is formed, optionally a substantially complete ring with separate portions. This may facilitate removal of the spacing devices when required without necessitating complete unthreading and removal of one of the body sections.

Optionally the or each spacer device has a first thickness dimension at its inner diameter and a second thickness dimension at its outer diameter. Optionally the second thickness dimension is less than the first thickness dimension, that is, optionally the or each spacer device reduces in thickness in a radial direction outwards from its inner diameter. Optionally the or each spacer device has one flat planar face that contacts an end of one body section. Optionally the or each spacer device has an opposing face that is angled, where the angled face contacts an end of another body section. Optionally the or each spacer device is thus tapered or dovetailed into the connection between two body sections, for example a mid sub and a bottom sub. Optionally having at least one planar face allows the connection to be fully torqued as the body section adjacent to the planar face will fully contact the surface of the planar face.

Optionally for normal valve operations the spacer device has a first maximum thickness, for example one inch. Optionally different maximum thicknesses of spacer devices may be used to achieve different operational outcomes as described in more detail below.

Optionally the spacer devices may be made from metal, optionally steel, or optionally a composite material.

Optionally the valve assembly may be connected between a top sub and a bottom sub and placed into the string. Optionally when pressure must be bled off, the weight of the string is first supported (for example by slips), before the connection between the string and the valve assembly is broken at a location above the valve assembly. Optionally the connection is broken by backing the connection out by one turn (optionally the connection between the top sub and the valve assembly), which optionally loosens the connection enough to remove the spacing device. Optionally after removal of the spacing device the connection is made up, optionally by making up the connection by five turns, for example. The additional axial space freed up by removal of the spacing device allows the pin connector to axially travel further into the box connector. Optionally where the connection is between the top sub and the valve assembly, as the pin connector travels axially into the box connector it engages the valve cartridge adjacent to the box connector. Optionally there are two or more valve cartridges connected in series. Optionally as the pin connector continues to be threaded into the box it pushes the adjacent valve cartridge in the same axial direction. Optionally the axial movement of the valve cartridge compresses the displacement mechanism that biases the valve cartridges in the uphole direction, thereby disengaging the displacement mechanism and allowing the valve to pivot freely around the pivot axle into an open configuration when pressure is equalised either side of the valve. Optionally where there are two or more valve cartridges each valve cartridge moves axially and each valve is allowed to pivot freely around the pivot axis.

Optionally the pressure differential across the valves can be equalised and the configuration of the valve or valves may be checked prior to initiating the bleed-off process by pumping mud or similar through the valve assembly. Optionally after bleed-off has been completed, the valve may be returned to the closed configuration by backing the connection out by as many turns as it was made up after removal of the spacer device, for example, five turns.

Optionally a spacer device with the first maximal thickness, for example one inch, may be replaced into the connection and the connection re-torqued. Optionally this spaces the pin and box connections so that the valve cartridges are not engaged by the pin connection and the valve or valves may return to the positively closed configuration, obturating the bore of the valve assembly.

Alternatively, after the connection has been backed out, a spacer device with a lesser maximal thickness than the original spacer device, for example a spacer device with a maximal thickness of 0.4-0.5 inches, may be installed in the connection. Optionally the connection is then re-torqued against the spacer device. Optionally the thinner spacer device allows the pin connection to compress the displacement mechanism that biases the valve cartridges in the uphole direction, thereby disengaging the displacement mechanism. The valve or valves then remain in the open configuration. The thinner spacer device thus permits both torqueing up of the connection and prevents the displacement mechanism from acting on the valve assembly to return the valve or valves to the closed configuration. Using the pin connection to actuate the valve assembly allows the valve or valves to be positioned in the open configuration, without requiring the lock-open sleeve to be run through the actuator on wireline or without requiring additional fixings that may become clogged, jammed, or damaged by debris or mud.

The various aspects of the present invention can be practiced alone or in combination with one or more of the other aspects, as will be appreciated by those skilled in the relevant arts. The various aspects of the invention can optionally be provided in combination with one or more of the optional features of the other aspects of the invention. Also, optional features described in relation to one aspect can typically be combined alone or together with other features in different aspects of the invention. Any subject matter described in this specification can be combined with any other subject matter in the specification to form a novel combination.

Various aspects of the invention will now be described in detail with reference to the accompanying figures. Still other aspects, features, and advantages of the present invention are readily apparent from the entire description thereof, including the figures, which illustrates a number of exemplary aspects and implementations. The invention is also capable of other and different examples and aspects, and its several details can be modified in various respects, all without departing from the spirit and scope of the present invention. Accordingly, each example herein should be understood to have broad application, and is meant to illustrate one possible way of carrying out the invention, without intending to suggest that the scope of this disclosure, including the claims, is limited to that example. Furthermore, the terminology and phraseology used herein is solely used for descriptive purposes and should not be construed as limiting in scope. Language such as "including", "comprising", "having", "containing", or "involving" and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes. Thus, throughout the specification and claims unless the context requires otherwise, the word "comprise" or variations thereof such as "comprises" or "comprising" will be understood to imply the inclusion of a stated integer or group of integers but not the exclusion of any other integer or group of integers.

Any discussion of documents, acts, materials, devices, articles and the like is included in the specification solely for the purpose of providing a context for the present invention. It is not suggested or represented that any or all of these matters formed part of the prior art base or were common general knowledge in the field relevant to the present invention.

In this disclosure, whenever a composition, an element or a group of elements is preceded with the transitional phrase "comprising", it is understood that we also contemplate the same composition, element or group of elements with transitional phrases "consisting essentially of", "consisting", "selected from the group of consisting of", "including", or "is" preceding the recitation of the composition, element or group of elements and vice versa. In this disclosure, the words "typically" or "optionally" are to be understood as being intended to indicate optional or non-essential features of the invention which are present in certain examples but which can be omitted in others without departing from the scope of the invention.

All numerical values in this disclosure are understood as being modified by "about". All singular forms of elements, or any other components described herein are understood to include plural forms thereof and vice versa. References to directional and positional descriptions such as upper and lower and directions e.g. "up", "down" etc. are to be interpreted by a skilled reader in the context of the examples described to refer to the orientation of features shown in the drawings, and are not to be interpreted as limiting the invention to the literal interpretation of the term, but instead should be as understood by the skilled addressee. In particular, positional references in relation to the well such as "up" and similar terms will be interpreted to refer to a direction toward the point of entry of the borehole into the ground or the seabed, and "down" and similar terms will be interpreted to refer to a direction away from the point of entry, whether the well being referred to is a conventional vertical well or a deviated well.

DETAILED DESCRIPTION OF THE INVENTION

Figure 1:
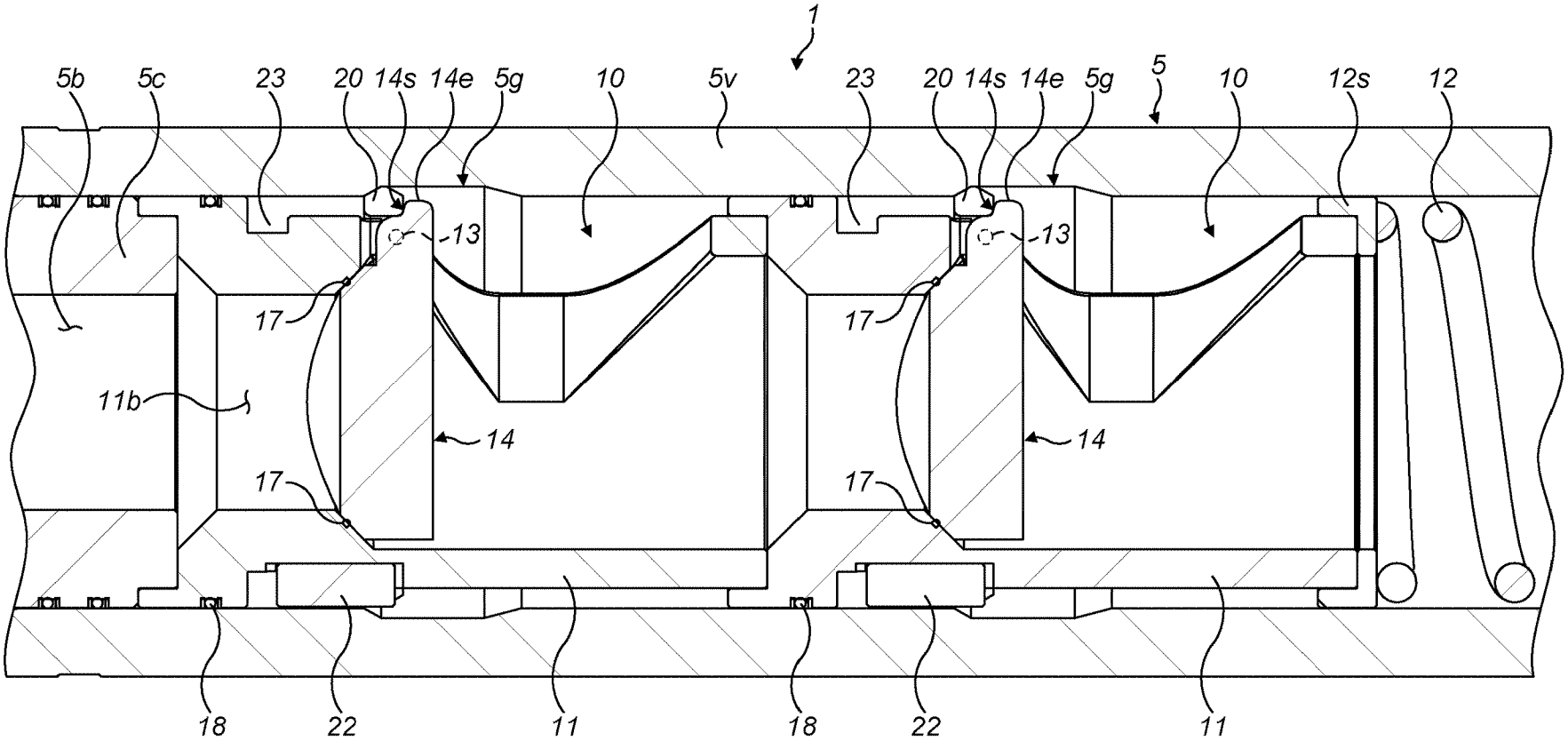
FIG. 1 shows a schematic of an example of the valve assembly in accordance with the present invention in the closed configuration, where the valve assembly forms part of a non-return valve (NRV) shown in FIG. 11.

Referring to FIG. 1, a first example of a valve assembly 1 used in an NRV tool in accordance with the present invention is shown as comprising a valve disposed within a valve body **5*v*. The valve body 5*v* is a part of a larger tool shown in full in FIGS. 11-18, comprising a tool body 5 made up of an upper body 5*u* with a female box connector at its upper end for making up the tool into a string for use in a wellbore, an actuator body 5*a* comprising an actuator assembly that will be described in detail below, a central body 5***c* connecting the actuator assembly to the valve assembly 1, and a lower body 51 below the valve assembly 1, having a male pin connector or similar for making the tool up into a string.

The skilled person will understand that the box connector of the upper body 5*u* is located at the, in use, uppermost end of the NRV tool and the pin connector of the lower body 51 is located at the, in use, lowermost end of the NRV tool.

The valve in the valve body 5*v* comprises a valve cartridge 10 having a valve member in the form of a flapper 14, with the flapper 14 disposed in a housing 11, the housing 11 having a central bore 11*b* which is coaxial and in communication with the bore 5*b* of the valve body 5*v*. The assembly 1 has two valve cartridges 10 arranged and in this example connected axially together in series by a narrowed lower section of the head of the upper cartridge 10 to the left hand side of FIG. 1. More than one valve cartridge 10 per valve assembly 1 is not necessary, but offers the advantage of redundancy in the event of failure of one of the valves. Interconnection of the cartridges 10 is also unnecessary, but optionally assists with movement of the valves in concert. In this example each cartridge 10 is adapted to move axially within the valve body 5*v*. Where two or more cartridges 10 are connected in series, as shown in FIG. 1, the cartridges 10 optionally move axially together as a single unit.

The valve assembly 1 further comprises a displacement mechanism, here in the form of a coiled spring 12, positioned outside of the fluid flowpath and axially aligned with the valve assembly 1. The spring 12 is axially spaced from the flapper 14 and has a wide coil diameter with a large axial bore that allows the body of the spring 12 to be radially spaced from the throughbore of the valve body 5*v*. The spring 12 engages with the end face of the housing 11 on a circumference of the housing 11, radially close to the outer edge of the housing 11, via a spring sleeve 12*s*, which centralises the lower end of the lowermost valve within the bore of the valve body 5*v*. The spring sleeve 12*s* has a top hat structure with an axial bore which receives (at its upper end) the lower end of the housing 11. At the lower end of the spring sleeve 12*s*, there is an annular plate presenting a flat surface for engaging the spring, and having a central aperture coaxial with the bore 11*b* (and no narrower than the bore 11*b*) to permit axial passage of fluids and equipment through the valve assembly. The spring 12 acts to urge the housing 11 axially within the valve body 5*v*, and is normally maintained in compression between the housing 11 and a shoulder (normally facing uphole) in the bore of the valve body 5*v* below the valves, hence urges the valves uphole in the valve body 5*v*. The spring 12 being sited outside of the fluid flowpath increases reliability and reduces turbulence through the valve. The spring 12 dimensions and spring rate of the spring 12 can be adapted within very wide parameters to suit the requirements of the valve assembly without compromising other aspect of the valve performance. In this example, the spring 12 has a wide diameter, acting around the circumference of the housing 11 via the spring sleeve 12*s*, is relatively long, and can optionally exert a relatively large axial force on the housing 11, and thus on the flapper 14. The flapper 14 will start to close at lower flow rates. In this example, the flapper 14 will close only in the absence of flow of fluid from above the valve.

The valve assembly 1 has a valve control member in the form of a valve control member or activation ring 20 which extends radially into the bore 5*b* of the valve body 5*v*, and acts to control the actuation status of the valve by relative movement of the activation ring and the valve. The activation ring 20 is optionally resiliently biased in a radial direction, and in this example, the activation ring 20 is resiliently biased radially outward from the axis of the bore 5*b*. In this example, the activation ring 20 remains static within the valve body 5*v*, and the axial movement of the housing 11 within the valve body 5*v* relative to the activation ring 20 actuates the flapper 14 between an open configuration and a closed configuration. When in the closed configuration as shown in FIG. 1, the flapper 14 is seated against chamfered or tapered edges of the housing 11 set at an angle to the axis of the bore and forming a valve seat at the downhole portion of the neck of the housing 11, and forming a metal-to-metal seal across the valve when the valve is closed. The tapered edges also contain a bonded seal 14, partially recessed in a groove within the chamfered surface of the seat, and largely protected from fluid flowing through the valve from uphole to downhole.

The housing 11 further has tapered edges at the uphole side of its neck portion, acting as an initial funnel of the fluid flow into the valve. The downhole chamfered edges diverge in an axial direction and thus protect the bonded seal 14 from the majority of the force of the fluid, which reduces in pressure as it passes through the neck of the valve seat when the valve is open.

The flapper 14 is pivotally connected to the housing 11 by a pivot that is integral to one of the valve member and the housing. In this case, the pivot comprises a pivot axle integral with the flapper 14 and extending in a perpendicular direction from opposing parallel side faces of a neck of the flapper 14, and an axle-receiving recess on the housing 11. The flapper 14 is therefore pivotally coupled to the valve housing 11 by a pivot axle formed as an integral part of the flapper 14 received within a groove formed in the valve housing 11. This arrangement avoids drilling holes through the flapper and housing and allows a stronger construction. Since no torsion spring needs to be accommodated between the flapper and the housing the tolerances between the two can be precise. Optionally the groove on the housing resiliently retains the integral pivot axle of the flapper, and resists separation of the two components in normal use. In this example, the flapper is able to move passively in a pivot arc around the axle with respect to the valve housing 11.

The spring 12 effectively replaces the conventional torsion spring wound around a pivot pin that is conventionally used in flapper valves. These springs and pins represent a high fatigue failure risk as they are positioned in the fluid flowpath, which also increases turbulence and erosion in the region of the flapper.

An upper face of an outer diameter of the activation ring 20 engages with a downwardly facing shoulder in a groove 5*g*, on the inner diameter of the valve body 5*v*, resisting axial travel of the activation ring up the bore of the valve body 5*v*. The activation ring 20 can travel down the groove 5*g*, but is biased against the downwardly facing shoulder at the upper end of the groove 5*g*, by the spring 12, held in compression below the valve.

The flapper 14 has a plate extending from the pivot axis 13 at the neck to engage the seat and close the valve as previously mentioned, and the plate extends away from the pivot axis in one direction (radially inwards from the pivot axis 13 when the valve is closed as in FIG. 1). The neck of the flapper 14 also has a tang having a flat faced shoulder 14*s* extending away from the pivot axis 13 in the same plane as the plate of the flapper 14, but in the opposite direction (radially outwards from the pivot axis 13 when the valve is closed). Thus when the flapper 14 is in the closed position as shown in FIG. 1, with the plate engaged with the seat of the valve, the flat face of the shoulder 14*s* on the flapper behind the pivot axis 13 therefore extends radially outwards from the pivot axis 13 in a radial direction with respect to the axis of the bore 11*b* beyond the radial position of the pivot axis 13, so that the outer edge of the flat faced shoulder 14*s* is offset from the pivot axis 13 in a radial direction with respect to the axis of the bore 5*b*. Thus there is an offset (here in a radial direction) between the point of contact between the flat face of the shoulder 14*s* of the flapper 14 and the activation ring 20 which extends radially into the bore 5*b* of the valve body 5*v*, and the pivot axis 13 of the flapper 14, such that in the closed configuration shown in FIG. 1, with the valve housing 11 moved fully up the bore 5*b*, the flat upper face of the shoulder 14*s* of the flapper 14 abuts against the flat lower face of the activation ring 20, at a position that is offset radially outwards from the axis of the bore 5*b*. The activation ring 20 cannot move up in the bore 5*b* of the body, as it is pressed (by the spring 12) against the downwardly facing shoulder at the upper end of the groove 5*g*, so the interaction of the shoulder 14*s* on the flapper with the lower face of the activation ring 20 urges pivotal movement of the flapper 14 as a whole around the pivot axis 13 and ultimately presses the flapper plate against the seat, closing the valve. The flapper 14 is restrained against rotation around the pivot axis 13 to open the valve when the flat upper face of the shoulder 14*s* is engaged with the flat lower face of the activation ring 20. The flapper 14 can be opened by a hydraulic or mechanically applied load from above urging the upper face of the flapper downwards, which initiates movement of the flapper 14 to unseat it from the housing 11 and from the activation ring 20, allowing rotation of the flapper 14 around the pivot axis 13 to open the valve.

The closed configuration as shown in FIG. 1 is the normal resting position. The spring 12 is compressed between an upwardly-facing end of the lower body 51 below the valve body 5*v* and the spring sleeve 12*s* engaging the lower end of the lower valve cartridge 10. The compression force of the spring 12 pushes the housing 11 of each of the valves upwards in the bore. The force of the compression spring 12 also urges the valves into the closed configuration from an open configuration, as the upward movement of the valve housings 11 in the bore under the force of the spring 12 pivots the flapper 14 around the pivot axis 13 as the inner edge of the activation ring 20 engages with a flat end face 14*e* on the shoulder 14*s* at a radial position that is offset from the pivot axis of the flapper 14, to rotate the flapper 14 around the pivot axis 13 into the closed configuration shown in FIG. 1. In order to release these engagements and open the valve, the cartridge 10 travels axially in the downhole direction and overcomes the force applied by the spring 12, for example under the force of a fluid pressure differential from high pressure above the valve, to low pressure below it.

In this example, the rotational position of the activation ring 20 is restrained such that it can interact with the pivoting end of the flapper 10. Thus, a key 22 in the form of an axial ridge is positioned on the housing 11 to occupy a space between the ends of the activation ring 20 and thereby prevent it from rotating out of its FIG. 1 rotational position.

Figure 2:
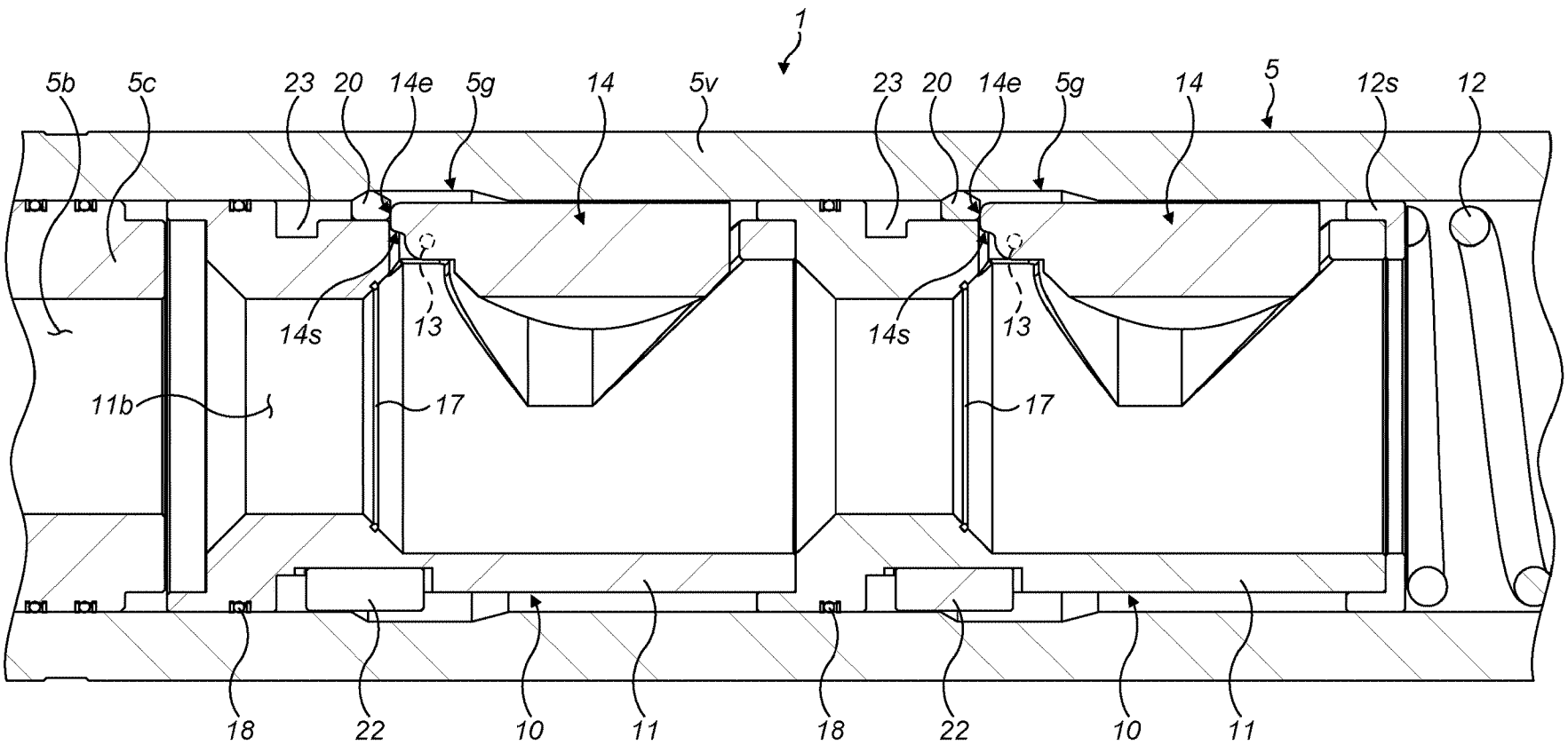
FIG. 2 shows a schematic of the valve assembly of FIG. 1 in the open configuration.

FIG. 2 shows the flapper 14 in the open configuration. The outer (lower when closed) face of the flapper 14 is curved, with a radius of curvature on its outer surface that optionally conforms with the curvature of the inner diameter of the valve body 5*v*. Likewise the inner (upper when closed) face of the flapper 14 is also curved, and in this example follows generally the radius of curvature of the inner surface of the bore of the valve housing 11. This curvature of the flapper 14 maximises the diameter of the throughbore in the housing. Maximising the diameter of the throughbore in turn leads to reduced fluid velocities and turbulence through the valve assembly 1, reducing the potential for washout and pressure drop across the valve assembly 1. Advantageously, as a result of this, the pressure rating of the flapper 14 can be increased to well above the pressure rating of conventional flat flapper designs, and adjusted for any particular combination of inner and outer radii of the flapper 10. The larger bore 11*b* in the housing 11 and the curved inner face of the flapper 14 also allows the passage of larger items of e.g. wireline equipment, drop balls etc. through the valve.

When the flapper 14 is fully open as illustrated in FIG. 2, the valve housing 11 has travelled in the downhole direction, compressing and energising the spring 12. The spring 12 is optionally already preloaded and is maintained in compression, and the axial travel of the valve housing 11 optionally increases the energy stored in the spring 12.

Figure 3:
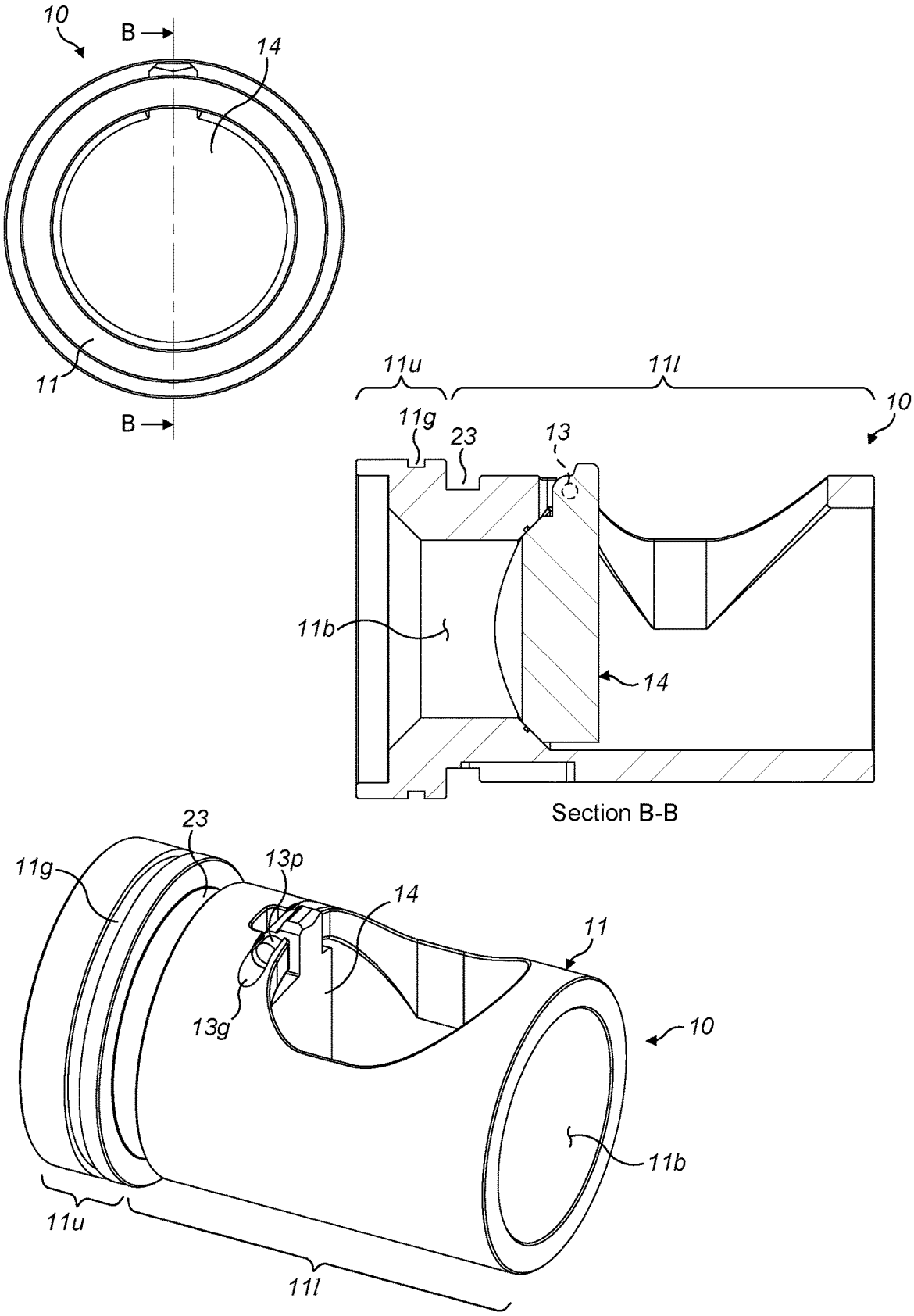
FIG. 3 shows perspective views of the valve assembly of FIG. 1 in the closed configuration.
Figure 4:
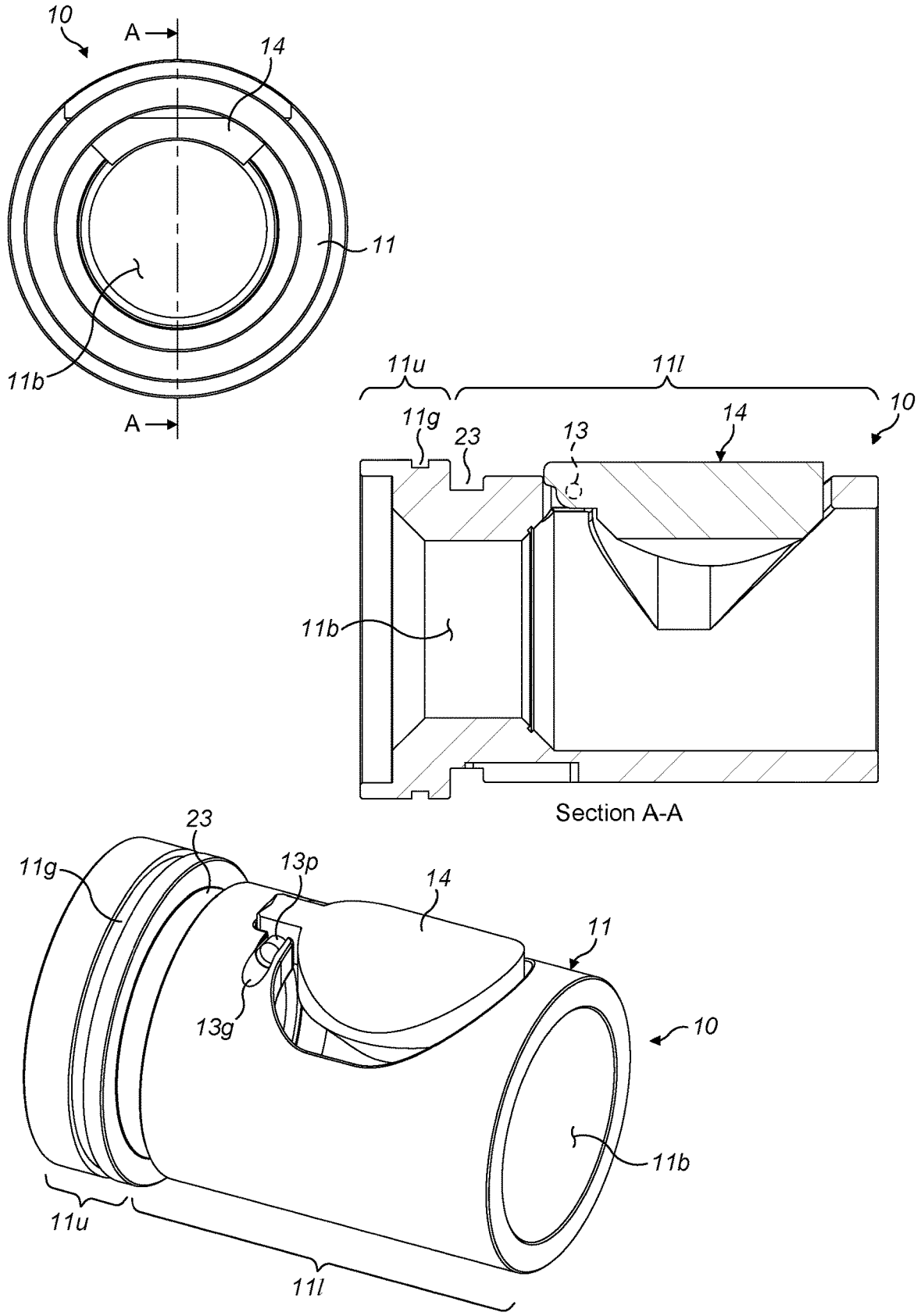
FIG. 4 shows perspective views of the valve assembly of FIG. 1 in the open configuration.

As can best be seen in FIGS. 3 and 4, each flapper 14 is pivotally connected to a housing 11 at a pivot axis 13, comprising a pivot axle 13*p*. Advantageously, the pivot axle 13*p* can be formed as an integral part of the flapper 14, received within a groove 13*g* in the housing 11 as previously explained. In this case, the axle 13*p* being an integral part of the flapper 14 removes the requirement for a bore through the pivot axis of the flapper 14 for retaining a pivot pin-torsion spring arrangement, which is a source of weakness and potential failure in conventional valves.

The housing 11 has an upper end 11*u* and a lower end 11*l*, see FIGS. 3 and 4. The housing 11 is sealed to the bore of the valve body 5*v* at seal 18, disposed in a circumferential groove 11*g* at the upper end 11*u* of the housing 11, below a counterbored upper face of the housing 11. Seal 18 is optionally a resilient annular seal in the form of an o-ring, and is compressed between the outer surface of the upper end 11*u* of the housing 11 and the inner surface of the valve body 5*v*. The lower end of the housing 11*l* has a reduced outer diameter, and houses the flapper 14. Disposed between the lower end 11*l* and the upper end 11*u* of the housing 11 is an annular groove 23, the function of which will be described below.

When the closed flapper 14 is exposed to high fluid pressures at its uphole surface that are sufficient to establish a high uphole to low downhole fluid pressure differential, the fluid pressure differential acts on the flapper 14 to apply a downward force tending to open the flapper 14. As long as the force of the spring 12 is greater than the force of the pressure differential the valve stays in the closed configuration of FIG. 1. However, as the downward force of the pressure differential overcomes the upward force of the spring 12, the cartridge 10 as whole is urged axially downwards in the bore 5*b* against the force of the spring 12. The flapper 14 partially opens during this movement by pivoting around the pivot axis 13 as it is no longer retained in position by the activation ring 20 pressing on the upper side of the neck of the flapper 14. During rotation of the flapper 14 around the pivot axis 13, the tang of the flapper remains in sliding contact with the activation ring 20. Opening of the flapper 14 permits a restricted fluid flow through the housing 11, leading to fluid flow with a pressure differential from high fluid pressure on the uphole surface of the valve to lower pressure on the downhole surface of the valve.

Should the fluid flow cease and the pressures on either side of the flapper 14 equalise, the flapper 14 will pivot back to the closed configuration and the cartridge 10 will by urged up the bore 5*b* under the force of the spring 12. However, as long as the force of the pressure differential overcomes the force of the spring 12, the valve cartridge 10 will continue to travel axially within the bore 5*b* until the flapper 14 reaches a fully open configuration as shown in FIG. 2.

The housing 11 and the flapper 14 together form the cartridge 10 that is received within the valve body 5*v*, and retained by the activation ring 20. In some examples, a single cartridge 10 is deployed in the valve assembly 1. In this example, two cartridges 10 are loaded into the bore 5*b* in series (more could be loaded in other examples), with their bores 11*b* in axial alignment. The counterbored upper end 11*u* of the housing 11 of the lower cartridge 10 with its larger outer diameter receives the smaller diameter lower end 11*l* of the housing 11 of the upper cartridge 1. The counterbored upper end 11*u* of the housing 11 of the upper cartridge 10 receives the lower end of the central body 5*c*, which has an identical narrow diameter portion adapted to fit into the counterbore of the upper cartridge 10. Hence the cartridges 10 can be modular, interchangeable, and identical to one another, and can be axially stacked in the bore 5*b* in different combinations, for example, 3, 4 or more cartridges 10 can be stacked in this way.

Each cartridge 10 is optionally retained in the body by a respective activation ring 20. The activation ring 20 extends around a the reduced outer diameter of the lower end 11*l* of the housing 11, between the annular groove 23 and the pivot axis 13 for the flapper 14. The pivot axis 13 is axially spaced from the annular groove 23, and the outer diameter of the lower end 11*l* between them is smooth and cylindrical, so the activation ring optionally 20 slides axially for a limited distance on the outer surface of the lower end 11*l* of the housing 11, as the housing 11 moves axially within the bore 5*b*. The extent of axial movement of the housing 11 is limited, and is demonstrated by comparing FIGS. 1 and 2, from which it is evident that the axial movement sufficient to permit pivotal movement of the flapper 14 is approximately the axial measurement of the activation ring 20, sufficient to move the counterbored upper end 11*u* axially downward in the bore 5*b* so that it just clears the narrow diameter lower end of the central body 5*c*.

The valve body 5*v* can be made up by connecting the upper end of the lower body 51 onto the lower end of the valve body 5*v* by means of screw threads, and offering the spring 12 to the bore of the valve body 5*v*. The valve cartridges 10 are offered to the bore 5*b* of the valve body 5*v*, with each activation ring 20 is aligned with the annular groove 23, and radially compressed into the groove 23 as it enters the bore 5*b*, where it remains during passage of the cartridge 10 through the bore 5*b* until the activation ring reaches the axial groove 5*g*, on the inner surface of the valve body 5*v*, at which point the activation ring 20 radially expands into the groove 5*g*, escaping the annular groove 23 on the outer surface of the housing 11, and permitting relative movement of the housing 11 in the bore 5*b* with respect to the radially expanded activation ring 20.

The cartridges 10 can be removable from the valve body 5*v*. Removal of the cartridge is achieved by exerting high force on the uphole side of the assembly 1 to axially move the housing 11 in the downhole direction. The force applied to the assembly 1 during removal is in excess of the forces that the valve assembly 1 would be subjected to in normal operation, and causes the valve assembly to travel further in the downhole direction than the normal axial displacement of the valve during operation. During this process, the radially extending shoulder formed by the lower face of the upper end 11*u* engages the upper face of the activation ring 20 and pushes the activation ring 20 so that the activation ring 20 is axially aligned with the annular groove 23 in the housing. The housing 11 and activation ring 20 together move axially downwards within the bore 5*b*, which causes the activation ring to travel axially downwards along the groove 5*g* in the inner wall of the body 5*v*. At the lower end of the groove 5*g*, there is a narrowing chamfer which compresses the activation ring 20 radially inwards against its natural outward resilience and forces the activation ring 20 radially into the annular groove 23 on the outer surface of the housing 11. This releases the restriction that the activation ring 20 places on uphole axial movement of the assembly 1 and permits continued movement of the cartridge or cartridges from the valve body 5*v*, optionally through the lower end of the valve body 5*v* once the lower body 51 has been removed.

The valve assembly 1 in this example is actuated by an actuator assembly for use in the oil, gas or water well, where the actuator assembly 50 is also (optionally) incorporated into the NRV tool. One example of the actuator assembly 50 is shown in FIGS. 5-10. The actuator assembly 50 is disposed in the actuator body 5*a*, between the central body 5*c* and the upper body 5*u*.

The actuator assembly 50 comprises a shuttle device, here in the form of a shuttle sleeve 80 having a bore that is co-axial with the axis of the actuator body 5*a*. The shuttle sleeve 80 optionally comprises a one piece sleeve having an upper portion 80*u*, a lower portion 80*l*, and a central portion 80*c* having a detent mechanism in the form of a collet device. The sleeve 80 is urged into a natural position by a biasing mechanism 81, which in this example takes the form upper and lower springs 81*u*, 81*l*, arranged radially around the upper and lower portions 80*u*, 80*l* of the sleeve 80. The springs 81 are optionally coiled springs arranged co-axial with the actuator body 5*a* and the shuttle sleeve 80. The springs 81 are optionally preloaded and held in compression between the tool body 5 and respective upper and lower spring sleeves 82*u* and 82*l*, and are biased in opposite directions, and optionally with balanced forces. The spring sleeves 82 urge the shuttle sleeve 80 within the actuator body 5*a* into the FIG. 5 natural or resting configuration. In some examples, the spring rates and preloads of the upper and lower springs 81 can be different, to provide different force thresholds during running in and latching, or overpull during removal of components from the actuator assembly.

Figure 20:
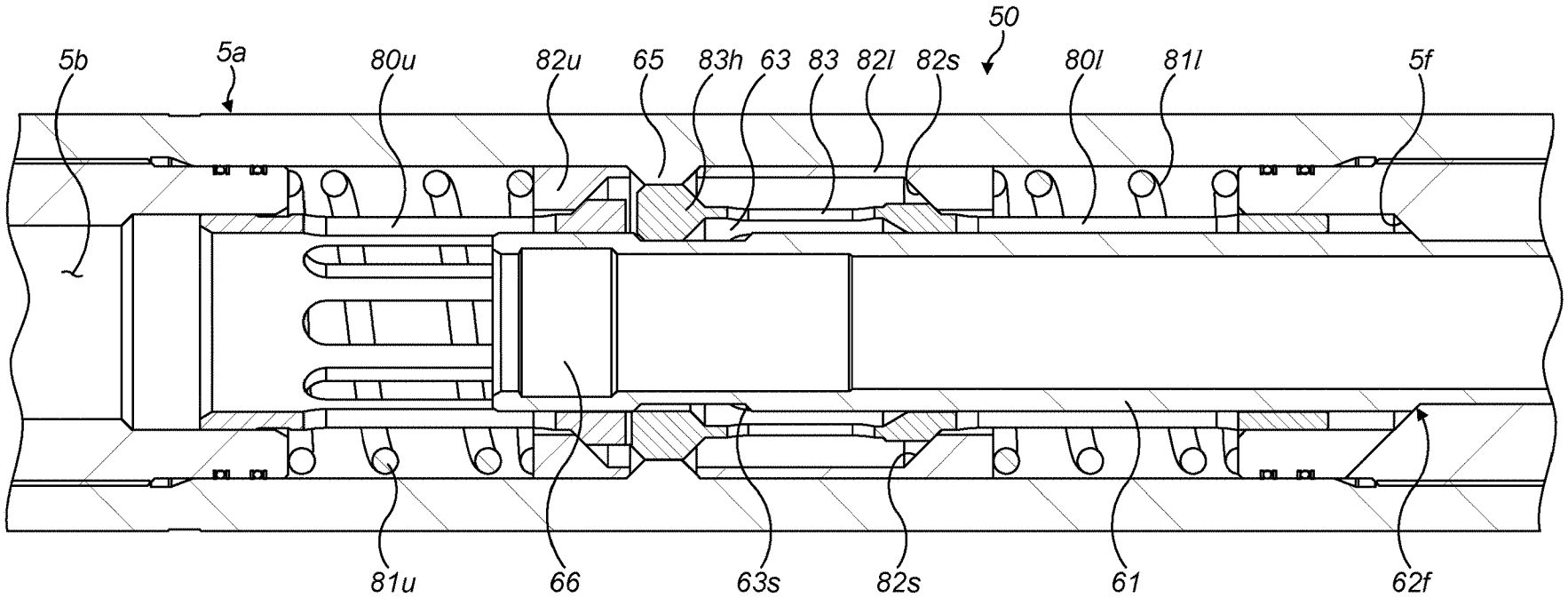
FIG. 20 shows a view of the actuator assembly similar to FIG. 8, but in a different section, showing the inter-engaging shoulders of the spring sleeves and the shuttle.
Figure 21:
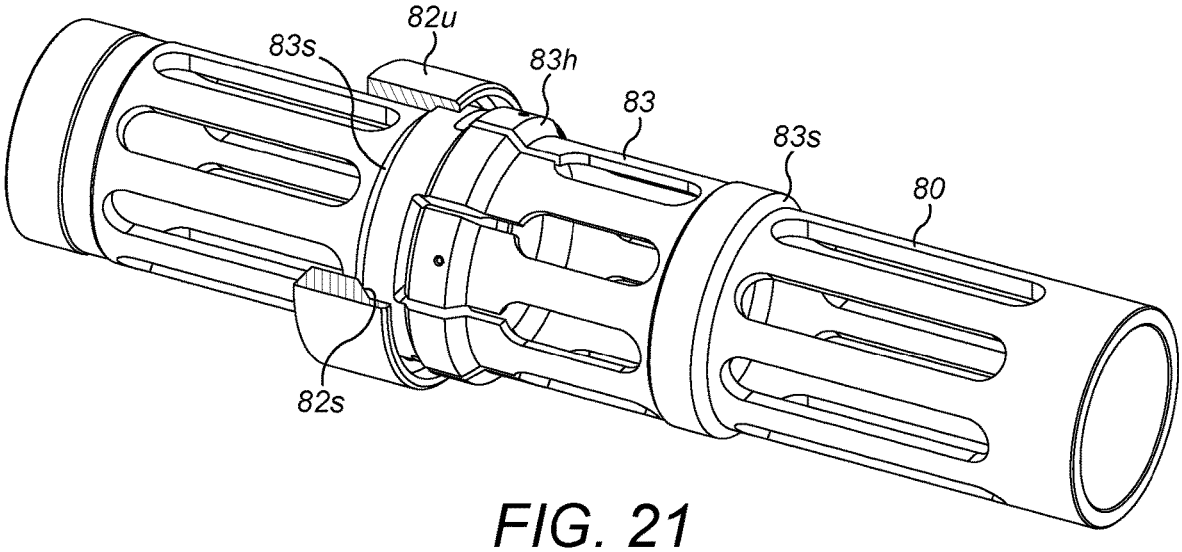
FIGS. 21 and 22 show perspective views of the shuttle device and upper spring sleeve respectively shown in isolation from the rest of the components of the actuator assembly of FIG. 5.
Figure 22:
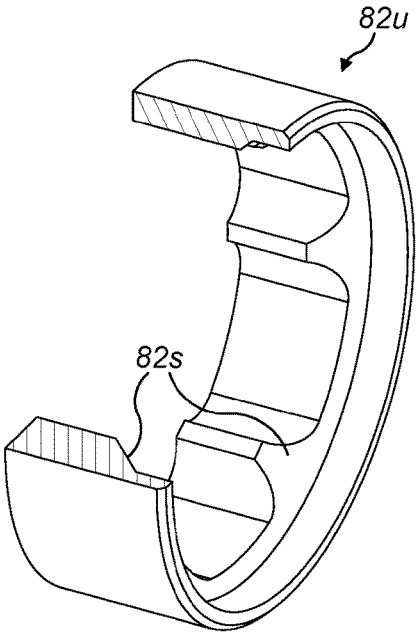

The upper spring 81*u* is maintained in compression between the lower end of the upper body 5*u*, and an upper end of the spring sleeve 82*u*, and urges the upper spring sleeve 82*u* downwards in the bore 5*b*. The upper spring 81*u* optionally surrounds the upper end 80*u* of the sleeve 80. The lower spring 81*l* optionally surrounds the lower end 80*l* of the sleeve 80, and is maintained in compression between the upper end of the central body 5*c*, and a lower end of the spring sleeve 82*l*, and urges the lower spring sleeve 82*l* upwards in the bore 5*b*. Thus the springs 81*u*, 81*l* act in axially opposite directions, urging the sleeve 80 into the natural position shown in FIG. 5 in the absence of any other forces. The springs 81 are radially surrounded by the actuator body 5*a*, the bore of which forms a portion of the throughbore of the tool body 5. As shown in FIGS. 20-22, the spring sleeves 82 each have a stepped structure with an inner flange forming a shoulder 82*s* arranged to engage a shoulder 83*s* of the shuttle sleeve 80.

Figure 5:
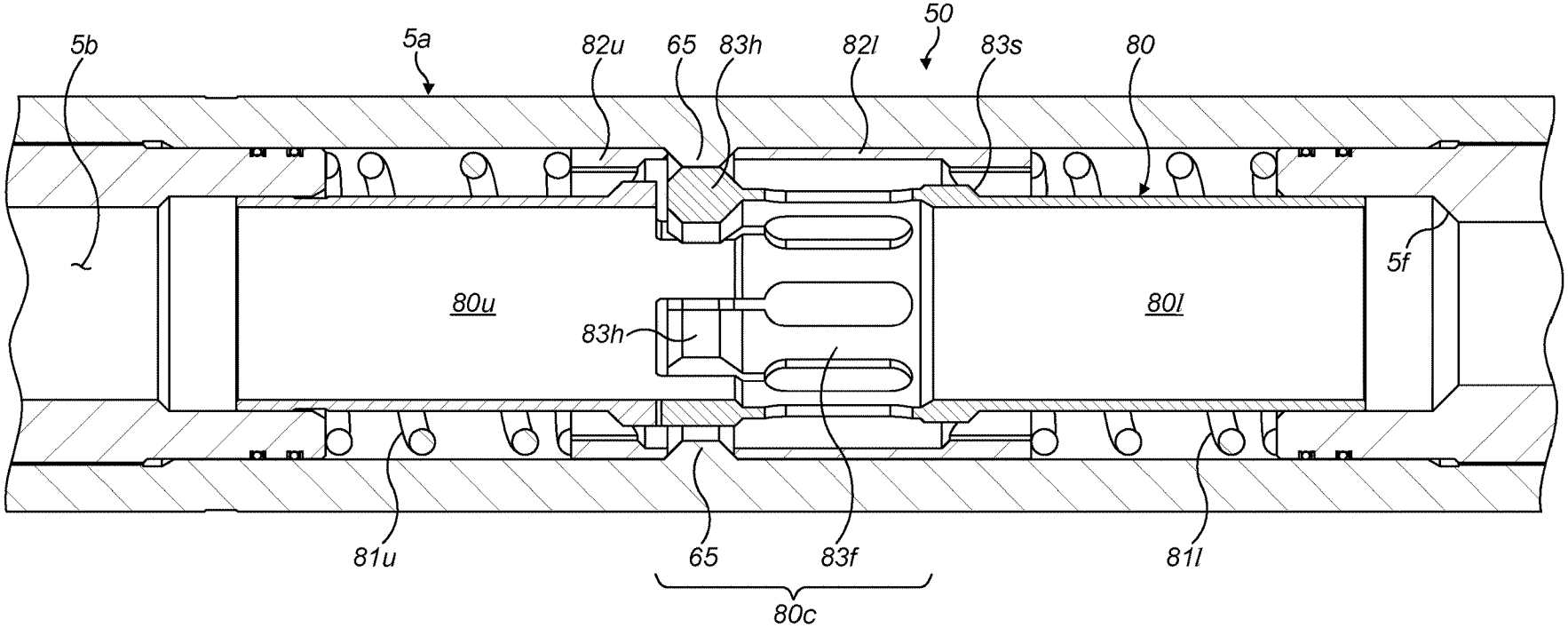
FIG. 5 shows a schematic of an example of a shuttle device which forms part of an actuator assembly in accordance with the present invention.

The central portion 80*c* of the shuttle sleeve 80 comprises a detent mechanism which controls the movement of the shuttle sleeve 80 and the operation of the actuator assembly as will be described below. In this example, the detent mechanism takes the form of a collet device having at least one collet member 83. In this example, a plurality of collet members 83 are circumferentially spaced around the central portion 80*c* of the shuttle sleeve 80. Each collet member 83 comprises a collet finger 83*f* attached in a cantilever manner to the shuttle sleeve 80 at one end of the collet finger 83*f*, and a collet head 83*h* on the free end of the collar finger 83*f*. Each collet head 83*h* optionally has a radially expanded cross-section, as best shown in FIG. 5. The shape of each collet head 83*h* is relatively complex, and each collet head 83*h* is multifaceted. Each collet head 83*h* has inner and outer parallel flat faces, which in this example extend parallel to the axis of the bore through the tool body 5. In this example, each collet head 83*h* also has radially extending upper and lower end faces, which optionally extend perpendicular to the axis-parallel inner and outer faces of the head 83*h*, and which are also flat. Further, the axially extending outer face is connected to each radially extending end face by an inclined face. At the upper end of the head 83*h*, likewise, the axially extending inner face is connected to each radially extending end face by an inclined face. The inclined faces connecting the end face with the inner and outer faces at the upper end of the head 83*h* optionally diverge in different directions. Therefore, at the upper end of the head 83*h*, the radially extending end face is connected to the outer face by an inclined face that extends radially outward at an angle less than 90 degrees, as best shown in FIG. 5. Conversely, at the upper end of the head 83*h*, the radially extending end face is connected to the inner face by an inclined face that extends radially inward at a similar angle. At the lower end of the head 83*h* the inclined face connecting the outer face with the radially extending end face is inclined radially inwards, whereas the inclined face connecting the inner face with the radially extending end face is inclined radially outwards. The net result of this arrangement is that the head 83*h* is multifaceted and polygonal, having a number of faces arranged at different angles, optionally in a regular and optionally symmetrical arrangement. The inclined faces at the upper end diverge away from one another, and those at the lower end converge towards one another. Optionally, the angles of the inner and outer inclined faces are equal and opposite, and are less than 90 degrees. In each head 83*h* arranged around the circumference of the central portion 80*c*, the angles of the inclined faces are optionally the same.

The spring sleeves 82*u*, 82*l* have opposing ends that are counterbored to receive the head 83*h* of the collet device 83. At the other end of each counter bore on each of the spring sleeves 82*u*, 82*l*, a chamfered shoulder is provided connecting the narrower diameter of the counter bore to a larger diameter of the spring sleeve 82. Optionally, the chamfered shoulder is arranged at the same angle as the inclined faces of the head 83*h*.

Figure 18:
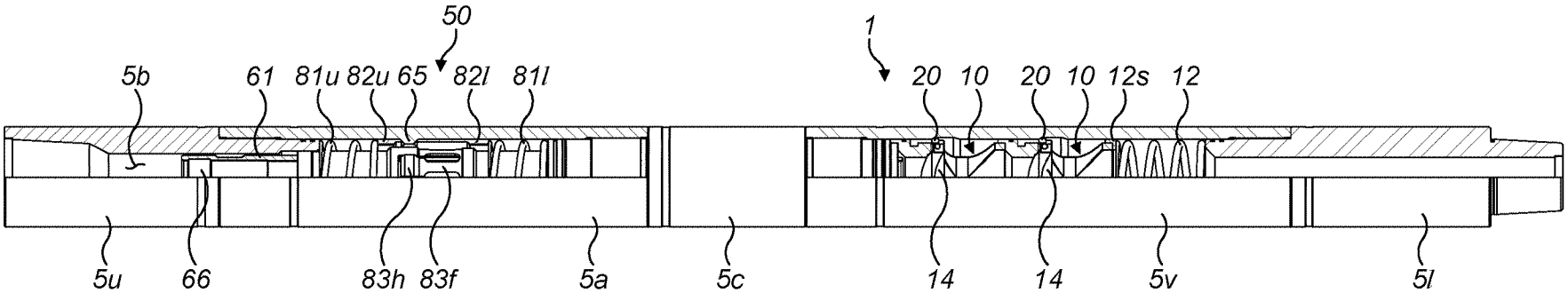
FIG. 18 shows a quarter cut cross-sectional view of the NRV tool of FIG. 13.

The outer surface of each spring sleeve 82*u*, 82*l* is a close fit with the inner diameter of the bore of the actuator body 5*a*. Each spring sleeve 82*u*, 82*l* is biased axially within the bore towards the other, and engages and opposite face of an internal ridge 65 extending radially inwards from the inner surface of the actuator body 5*a*. Thus, each spring 81*u*, 81*l* is maintained in compression within the actuator body 5*a* between the respective upper and central body portions 5*u*, 5*c*, acting to drive the spring sleeves 82*u*, 82*l* in opposite directions against opposing faces of the internal ridge 65. As shown in FIG. 18 the spring sleeves 82 each have a stepped structure with a radially inwardly extending flange providing a shoulder 82*s* arranged to engage the shuttle sleeve 80 and drive it axially within the bore towards the ridge 65. The shoulders 82*s* of the upper and lower spring sleeves 82*u*, 82*l* engage radially outwardly extending shoulders 83*s* on the shuttle sleeve 80, which are advantageously arranged between the radially inwardly extending flanges on the spring sleeves and the ridge 65, so that axial movement of either of the spring sleeves 82 towards the ridge 65 engages the shoulders between the spring sleeves and the shuttle sleeve, and drives the shuttle sleeve 80 towards the FIG. 5 natural position until the axially facing end faces of the spring sleeves 82 abut the opposite faces of the ridge 65, as shown in FIG. 20. Likewise, axial movement of the shuttle sleeve 80 relative to either one of the spring sleeves 82*u*, 82*l* causes the shoulders to enter engage, and causes the shuttle sleeve 80 to drive axial movement of the relevant spring sleeve 82, which compresses the spring and allows continued axial movement until a portion of the shuttle sleeve 80 engages a radially inwardly extending restriction the inner diameter of on one of the upper body portion 5*u* or central body portion 5*c*. The spring sleeves 82 thus move with the collet and as this happens, the collet head 83 expands into the internal diameter of the main actuator body 5*a* which is exposed as the spring sleeves 82 move axially away from the ridge 65. Thus the flanges of the spring sleeves 82 permit the transmission of force from the shuttle sleeve 80 to the spring sleeves to force them in opposite axial directions away from the ridge 65 to compress the springs 81 as the shuttle sleeve 80 moves axially in the bore, as will be described below.

The natural resting position of the shuttle sleeve 80 is arranged such that the distal end of the collet finger 82*f*, i.e. the head 83, is positioned radially inside the internal ridge 65 on the actuator body 5*a*. The internal ridge 65 protrudes into the bore of the actuator body 5*a* to create a small narrowed portion of the bore 5*b*. The two axially-spaced springs 81*u*, 81*l* are pressed against the internal ridge 65 with no axial force being applied to the shuttle sleeve as long as the shuttle sleeve 80 remains in the natural resting position shown in FIG. 5.

Figure 6:
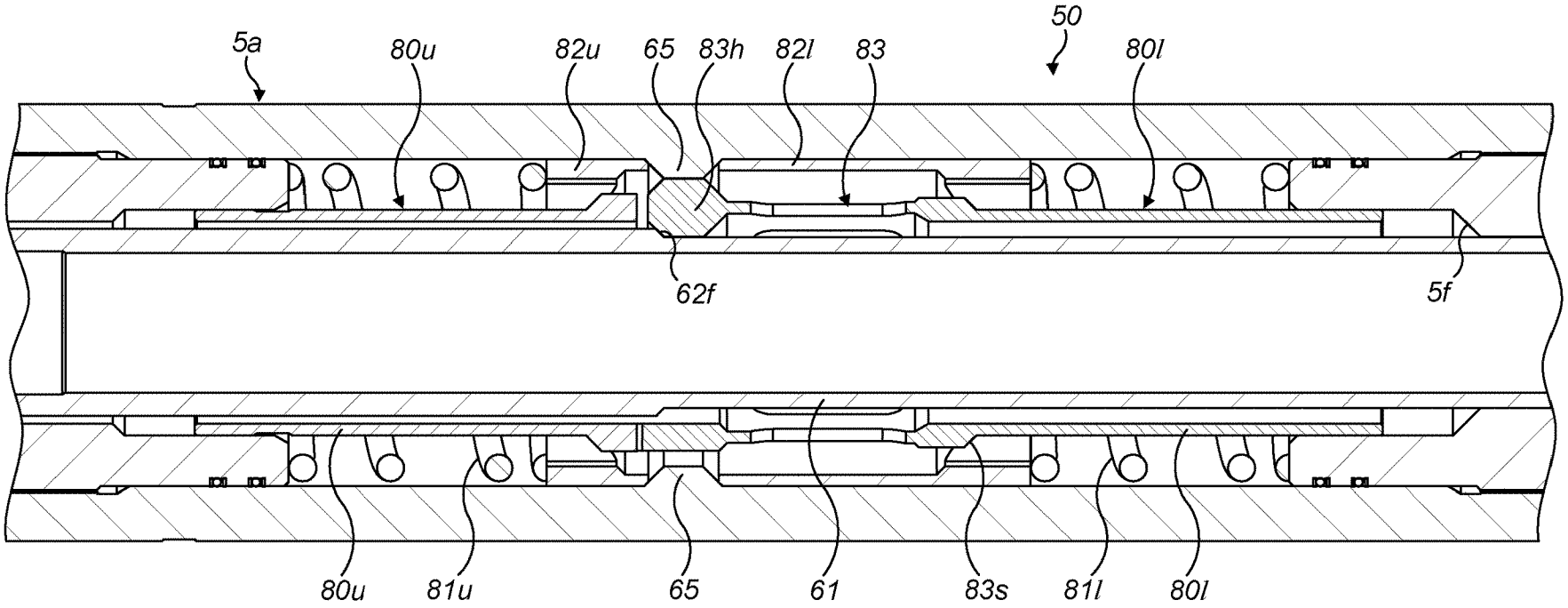
FIG. 6 shows a schematic of the shuttle device of FIG. 5 with an example of the actuator member passing through it, and engaging a collet device.

An actuator member, in this example in the form of an actuating sleeve 61 having a bore with an axis parallel to the axis of the bore 5*b*, is deployed through the bore of the tool body 5 from the surface, for example, via wireline, and passes through the bore of the shuttle sleeve 80 as shown in FIG. 6, such that the shuttle sleeve 80 radially surrounds at least a portion of the actuating sleeve 61. The actuating sleeve 61 is co-axial with the shuttle sleeve 80 and the actuator body 5*a*.

The actuating sleeve 61 has an annular groove 63 formed in its outer diameter, and close to its upper end, and a chamfered shoulder 62*f* below it facing the lower end of the actuating sleeve 61. The annular groove 63 has chamfered upper and lower ends, optionally set at the same angle as the inclined faces on the head 83*h* of the collet device. At the chamfered shoulder 62*f*, the wall thickness and the outer diameter of the actuating sleeve 61 both reduce, so that the section of the actuating sleeve 61 below the chamfered shoulder 62*f* has a reduced diameter, and a reduced wall thickness.

As the actuating sleeve 61 travels through the shuttle sleeve 80 in a downhole direction, the downwardly facing chamfered shoulder 62*f* on the outer diameter of the actuating sleeve 61 engages with an upwardly facing inclined face on the inner surface of the collet head 83*h*, as shown in FIG. 6. Optionally, the downwardly facing chamfered shoulder 62*f* and the upwardly facing inclined face on the inner surface of the collet head 83*h* are set at the same angle. The smaller outer diameter of the actuating sleeve 61 below the chamfered shoulder 62*f* can pass through the collet device without engaging the collets, but the larger outer diameter of the actuating sleeve is wider than the inner faces of the collet head 83*h*, so further axial travel of the actuating sleeve 61 past this point pushes the collet heads 83*h* (and therefore the whole of the shuttle sleeve 80) downwardly in the bore 5*a* of the actuator body 5*a*.

Figure 7:
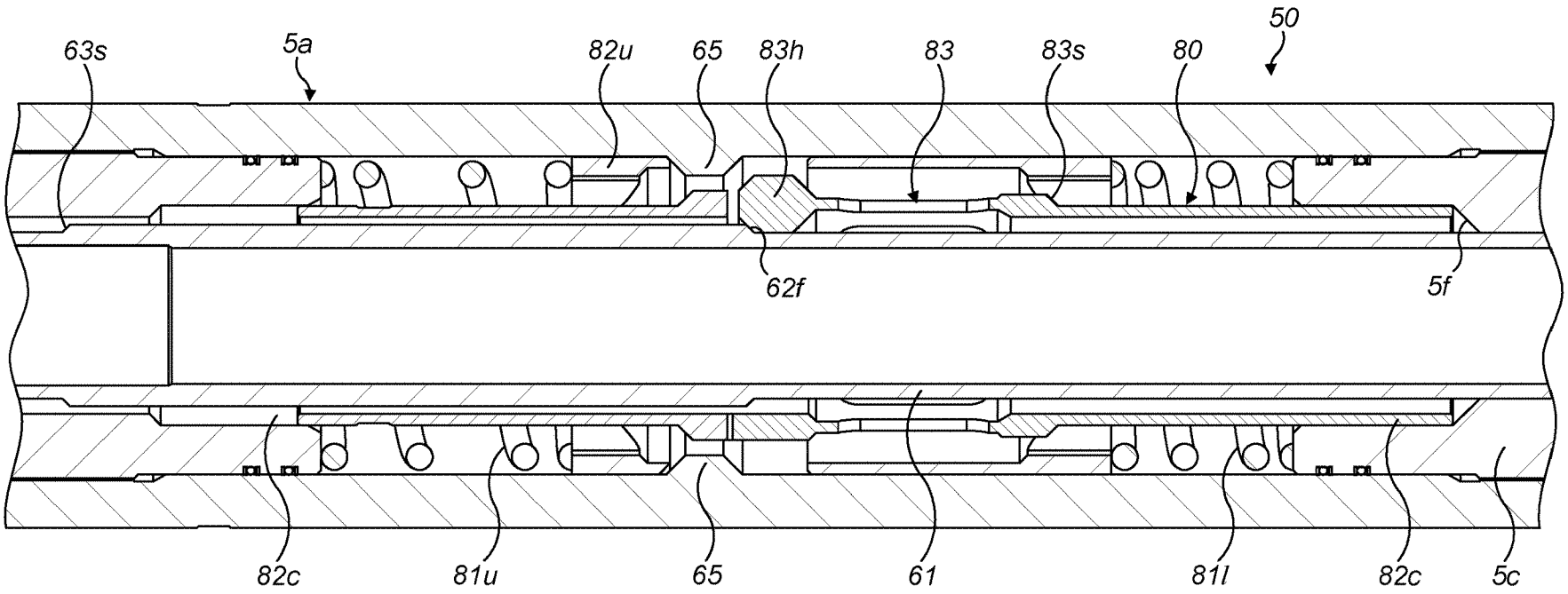
FIG. 7 shows a schematic of the actuator assembly of FIG. 5 with the actuator member of FIG. 6 moving axially with the shuttle device and disengaging the collet device.
Figure 8:
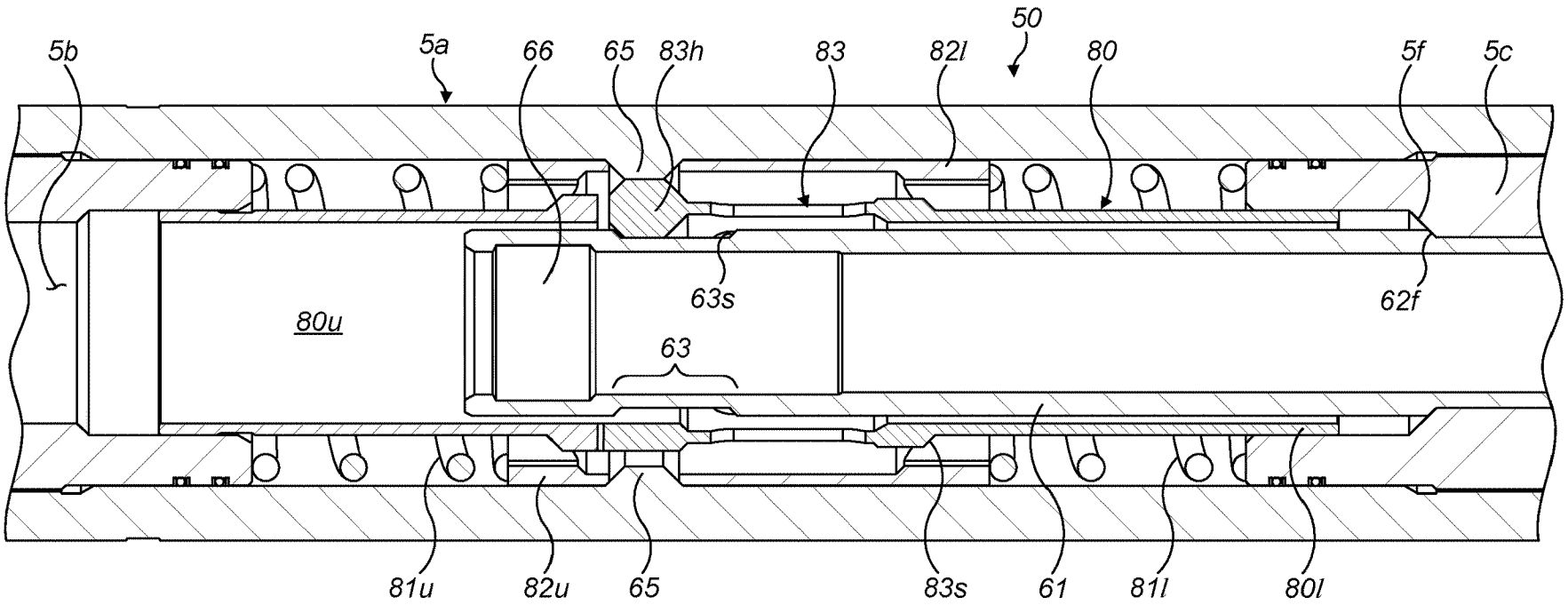
FIG. 8 shows a schematic of the actuator assembly of FIGS. 6 and 7 with the actuator member re-engaging the collet device and engaging the body such that axial movement is restrained.

FIG. 7 shows the position after the actuating sleeve 61 has moved further downhole through the shuttle sleeve 80, under force applied from further uphole, optionally from the surface. The collet head 83*h* cannot move radially outward around the cantilever connection with the sleeve at the opposite end of the collet finger, until the head 83*h* has moved axially downwards for a sufficient distance to disengage from the ridge 65. As the head 83*h* axially clears the ridge 65 the chamfered shoulder 62*f* of the actuating sleeve 61 is initially still engaged with the collet finger head 83, and the downward movement of the actuating sleeve 61 continues to urge the shuttle sleeve 80 axially in the direction of travel of the actuating sleeve 61, energising the lower springs 81.

The range of axial movement of the shuttle sleeve 80 is limited by the lower end of the shuttle sleeve 80 bottoming out on an inner shoulder on the central body portion 5*c* as shown in FIG. 7. At this stage, the shuttle sleeve 80 cannot move any further in the axial direction, and the spring 81 does not compress any further. The head 83*h* of the collet device has now moved down sufficiently to be clear of the internal ridge 65, and is no longer restricted against radial movement, so the head 83*h* moves radially outward into the space between the internal ridge 65 and the upper end of the spring sleeve 82*l*, which allows the inner face of the head 83*h* to move radially away from the chamfered shoulder 62*f* by pivotal movement around the cantilever connection with the shuttle sleeve 80. As the head 82*h* moves radially outwards clear of the chamfered shoulder 62*f*, the actuating sleeve 61 can then resume its downward movement within the bore until the chamfered shoulder 62*f* engages the upper surface of an inwardly extending and upwardly facing chamfered shoulder 5*f* on the inner surface of the central body portion 5*c*, at which point further axial movement of the actuating sleeve 61 is prevented. This is the position shown in FIGS. 15-17, and FIG. 8. The actuating sleeve 61 is thus prevented from moving any further downhole and in this example is in position to actuate the downhole tool.

Figure 15:
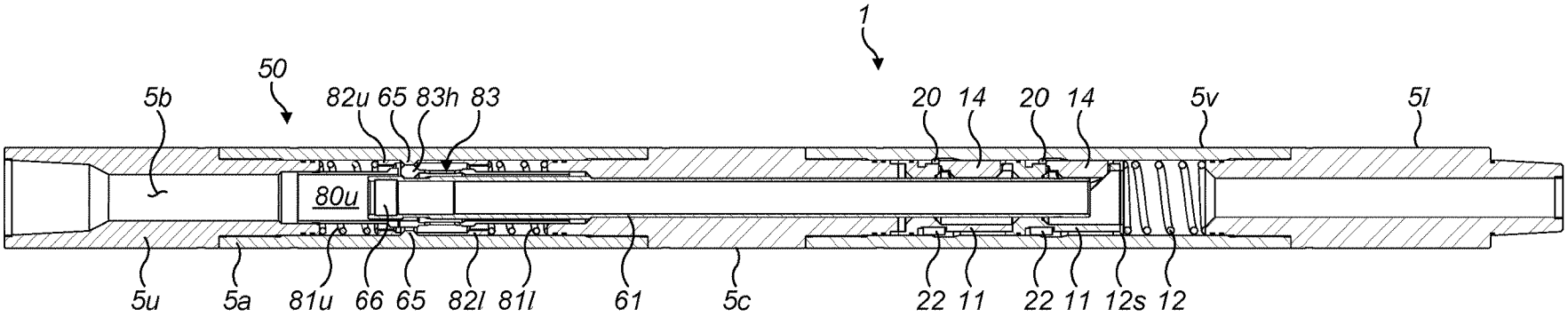
FIG. 15 shows a schematic of the NRV tool of FIGS. 13 and 14, with the actuator member actuating the valve assembly into the open configuration.
Figure 16:
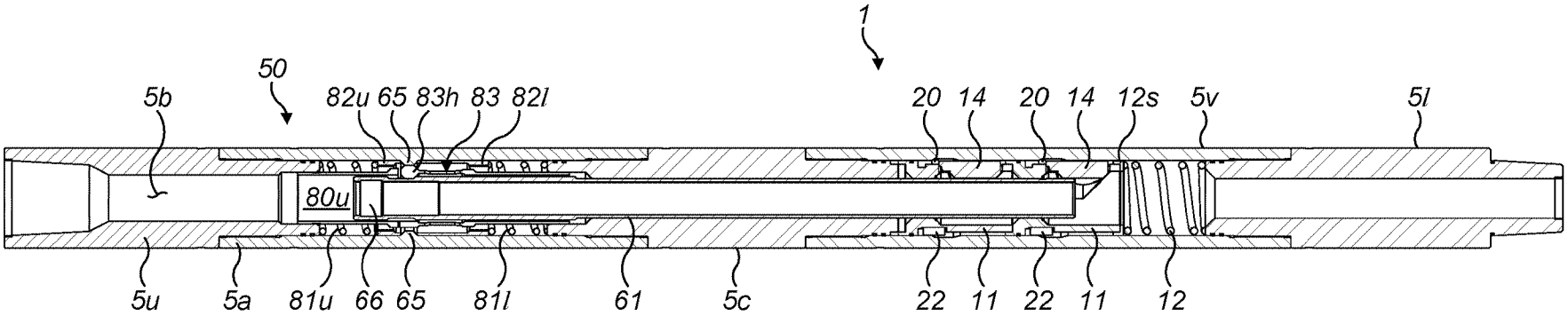
FIG. 16 shows a schematic of the NRV tool of FIG. 15, where the actuator member is beginning to be retracted from the bore.
Figure 17:
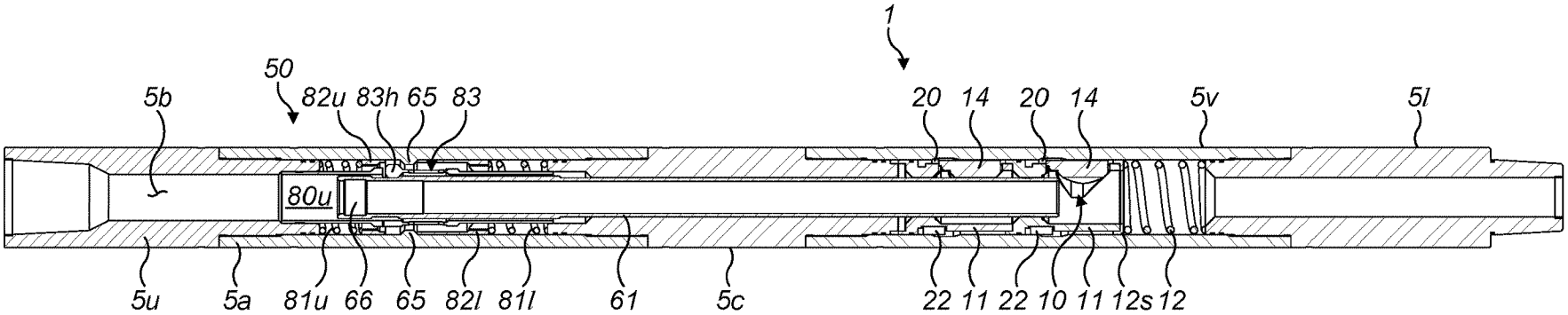
FIG. 17 shows a schematic of the NRV tool of FIG. 16, where the actuator member has been retracted further away from the valve assembly and again disengaging the collet device.

While the actuating sleeve 61 is moving axially to the position shown in FIGS. 15 to 17, and before it is reached that position, the larger diameter outer surface of the actuating sleeve 61 above the chamfered shoulder 62*f* is keeping the head 83*h* of the collet device radially extended from the position shown in FIG. 7, so that the inclined face on the head between the outer face and the end face is engaged against the lower side of the ridge 65. In this configuration, the head 83*h* cannot move past through the narrow annular space between the inner surface of the ridge 65 and the outer surface of the large diameter portion of the actuating sleeve 61 between the recess 63 and the shoulder 62*f*, so until the actuating sleeve 61 has reached the end of its downward travel, the shuttle sleeve 80 is held in the position shown in FIG. 7, but with the collet head 83*h* radially extended and engaging the lower surface of the ridge 65, and with the lower spring sleeve 82*l* compressing the lower spring 81*l*.

In this example, the downhole tool actuated by the actuator assembly 50 is the flapper assembly 1 previously described. The force exerted in the downward axial direction by the movement of the actuating sleeve 61 through the bore is transferred to the upper surface of the closed flapper by the end of the actuating sleeve 61 as it moves axially downwards past the position shown in FIG. 14.

When the actuating sleeve 61 has moved axially downwards within the bore to the position shown in FIGS. 15 to 17 and FIG. 8, the annular groove 63 in the outer diameter of the actuating sleeve 61 is axially aligned with the radially extended collet head 83*h*, and positioned radially inside it. The head 83*h* is therefore no longer kept in the radially extended position by the large diameter inner surface of the actuating sleeve 61, and is allowed to move resiliently in a radial inward direction into the annular groove 63 in the outer diameter of the actuating sleeve 61. This allows the head 83*h* to clear the inner surface of the ridge 65, which allows the shuttle sleeve 80 to move axially upwards under the force of the lower spring 81*l* to its resting position, wherein the head 83*h* is positioned in axial alignment with the internal ridge 65. The tool is then in the configuration shown in FIG. 8, and FIGS. 15 to 16. The actuating sleeve 61 is now retained in this position and will take significant force to overcome the preload of the upper spring 81*u* to move it.

Figure 9:
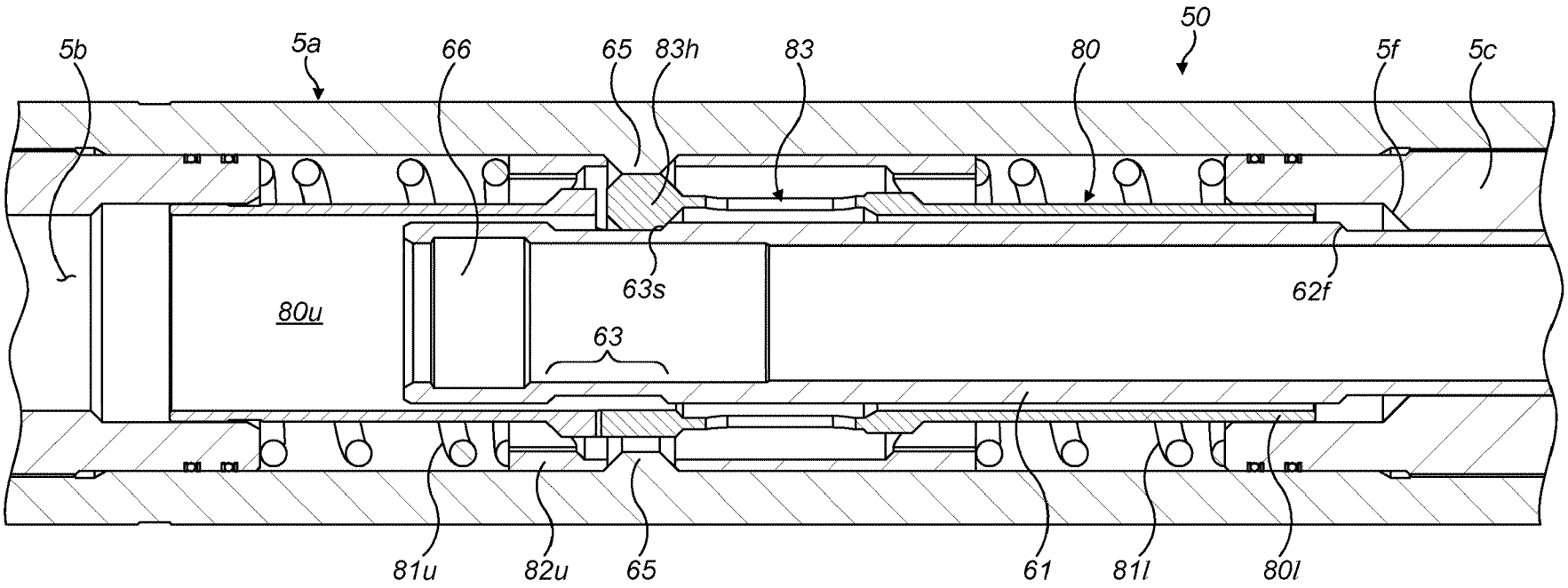
FIG. 9 shows a schematic of the actuator assembly of FIGS. 6-8 as the actuator member begins retraction, disengaging the body while maintaining engagement of the collet device.
Figure 10:
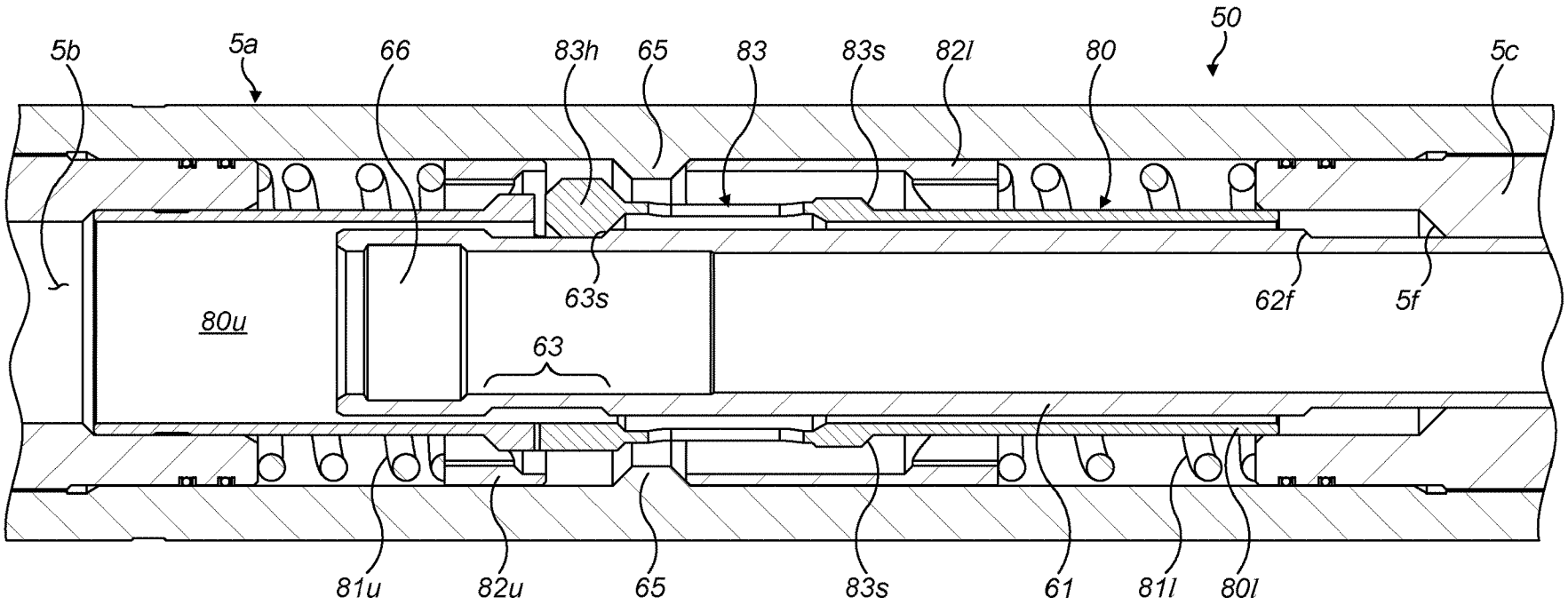
FIG. 10 shows a schematic of the actuator assembly of FIGS. 6-9 as the actuator member continues retraction, moving axially with the shuttle device and disengaging the collet device.
Figure 11:
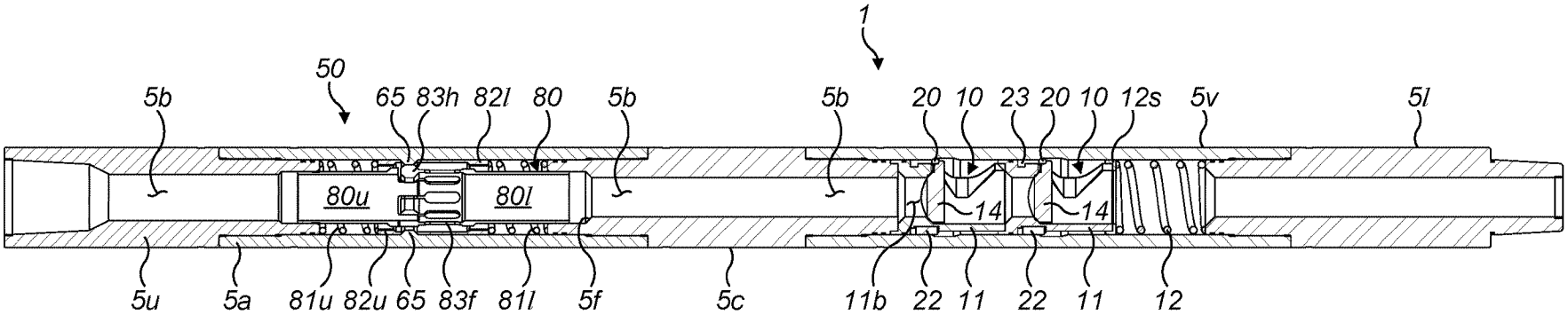
FIG. 11 shows a schematic cross-sectional view of first example of a fully assembled non-return valve (NRV) tool incorporating an actuator assembly in accordance with the present invention (and which incorporates the shuttle device of FIG. 5) connected uphole of a valve assembly of FIG. 1 for actuation, the valve assembly being in the closed configuration.
Figure 12:
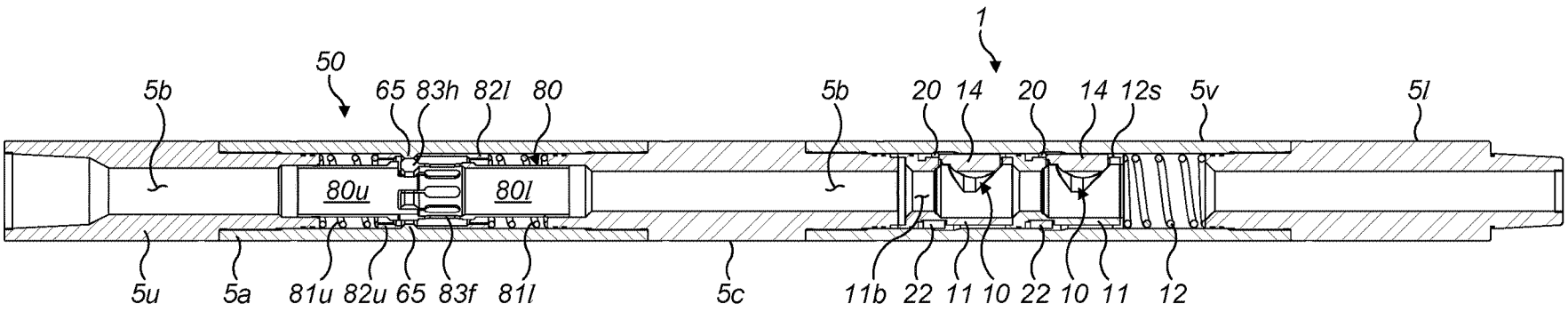
FIG. 12 shows a schematic of the NRV tool of FIG. 11, with the valve assembly in the open configuration.
Figure 13:
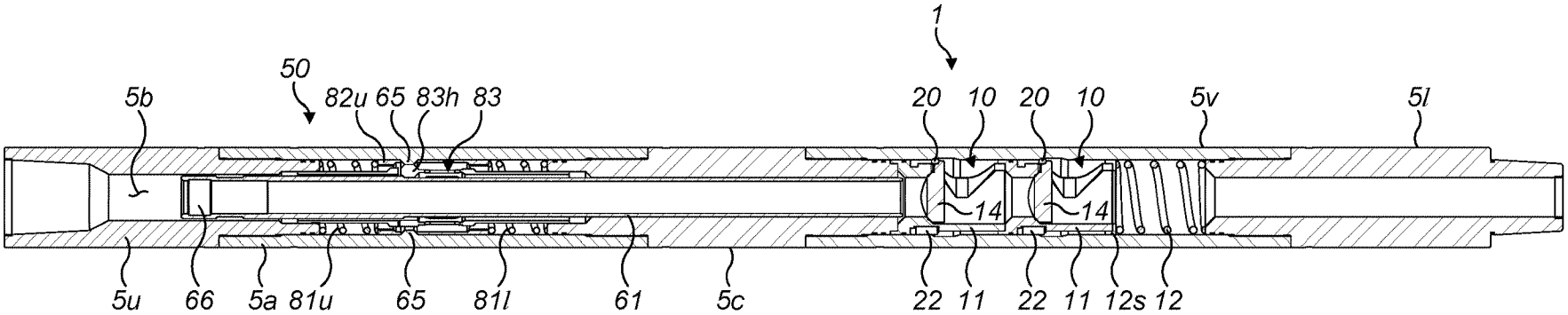
FIG. 13 shows a schematic of the NRV tool of FIG. 11, with an actuator member passing through the actuator assembly and engaging the collet device.

FIG. 9 shows the start of the retraction process for recovering the actuating sleeve 61 from the wellbore when the valve is to be closed. The actuating sleeve 61 includes an internal fishing neck 66 for retraction of the sleeve by e.g. a wireline or other fishing tool which can hook onto the inner surface of the sleeve 61. As the sleeve 61 is pulled axially in the uphole direction, the collet finger head 83 engages a chamfered shoulder 63*s* in the lower end of the annular recess 63 as shown in FIG. 9. The shuttle sleeve 80 is thus moved axially in the uphole direction of travel of the actuating sleeve 61, energising the springs 81, as shown in FIG. 10.

Figure 14:
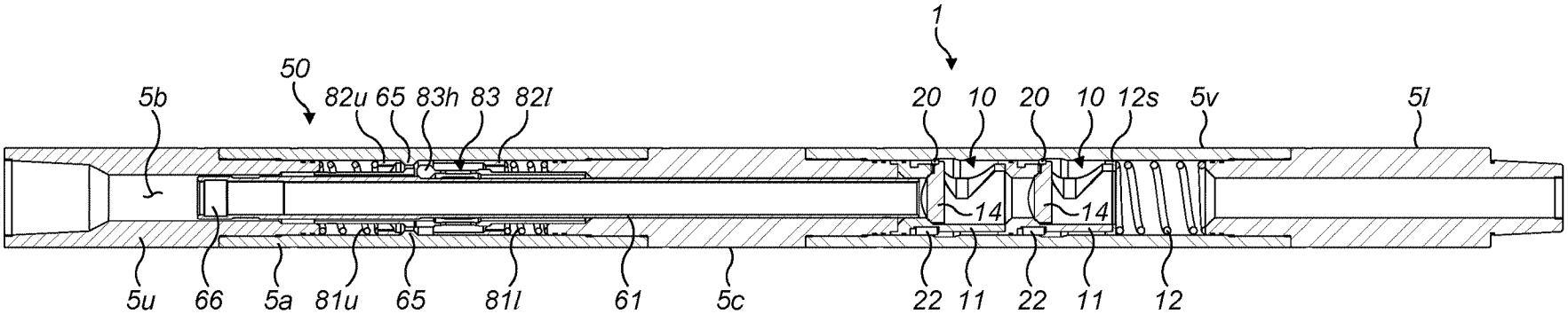
FIG. 14 shows a schematic of the NRV tool of FIG. 13, the actuator member moving axially with the shuttle device towards the valve assembly, disengaging the collet device.

As shown in FIG. 14, as the shuttle sleeve 80 moves axially upwards with the actuating sleeve 61, the collet head 83*h* moves above the internal ridge 65 and is free to expand in a radial direction away from the axis of the bore of the shuttle sleeve 80, as the head 83*h* moves up the inclined face of the lower chamfered surface 63*s*, and once more moves along the larger diameter portion of the outer surface of the actuating sleeve 61 below the recess 63. This serves to free the recess 63 of the actuating sleeve 61 from its engagement with the collet head 83*h* and allows free retraction of the actuating sleeve 61 through the bore of the tool. The collet head 83*h* remains in its radially expanded configuration above the ridge 65 until the chamfered surface 62*f* moves axially past the collet head 83*h* and permits its resilient return to its resting configuration, parallel to the axis. In the radially expanded configuration, the collet head 83*h* is still maintained above the ridge 65, despite being urged by the action of the upper spring 81*u* in a downward axial direction as it cannot fit into the narrow annular space between the larger diameter of the actuator sleeve 61 and the ridge 65. However, after the chamfered surface 62*f* moves past the collet head 83*h* and the outer diameter of the actuator sleeve 61 reduces, the collet head 83*h* can move radially inwards, allowing the shuttle sleeve 80 to resume the natural position shown in FIG. 11 under the force of the upper spring 81*u*, as the remainder of the actuating sleeve 61 below the chamfered surface 62*f* is withdrawn from the tool.

FIGS. 11-17 show the valve assembly 1 together with the actuator assembly 50.

The valve assembly 1 can be actuated into the open configuration either under the force of fluid pressure alone, or by mechanical actuation, in this example by using the axial movement of the actuating sleeve 61.

The actuating sleeve 61 actuates the valve assemblies by passing through the shuttle sleeve 80 as described above. For brevity, this process is not described again here.

Figure 19:
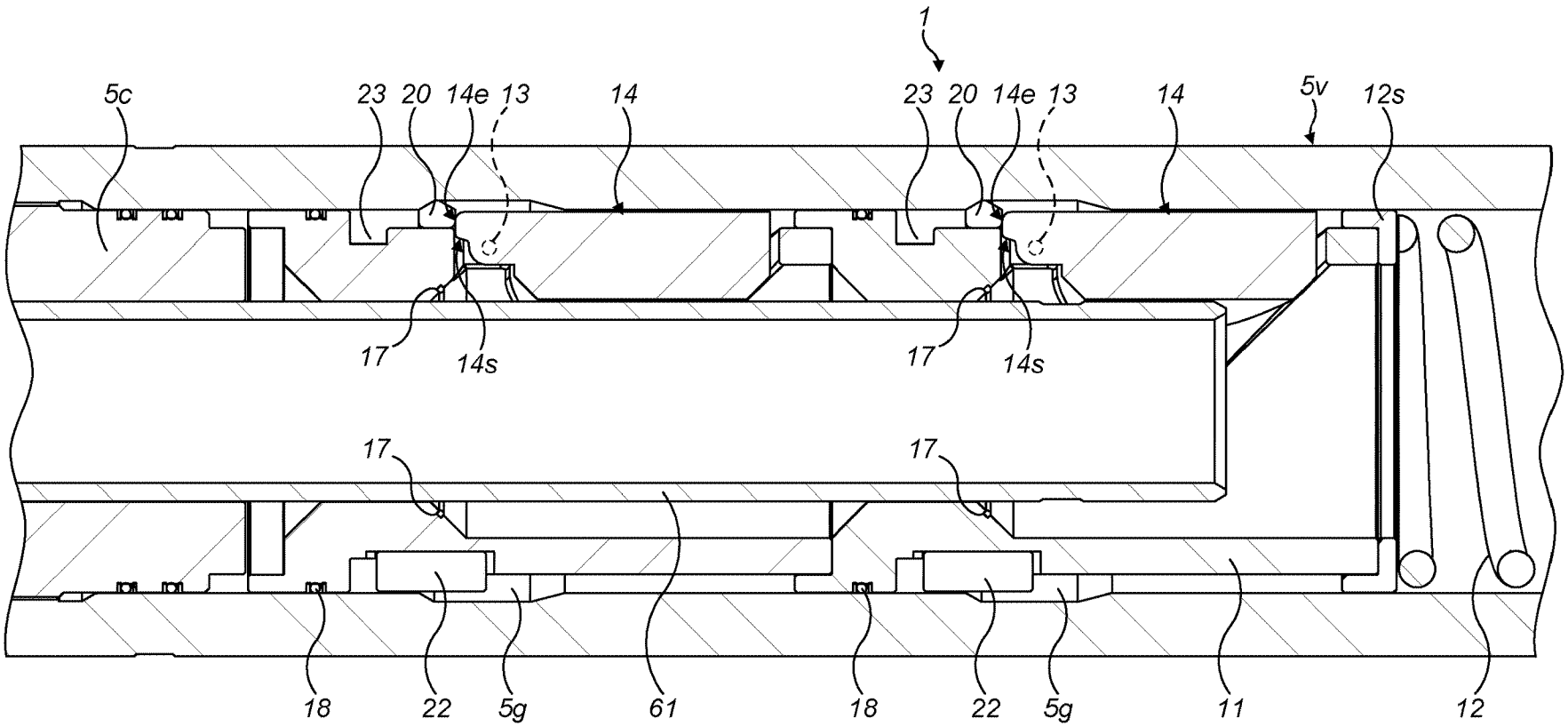
FIG. 19 shows a close-up schematic view of the valve assembly of the NRV tool when in the configuration of FIG. 15, with the actuator member holding the valve members in the open position.

Once the actuating sleeve 61 contacts the uphole flapper 14, continued force applied on the sleeve 61 forces the valve housings 11 to travel axially in a downhole direction, energising the spring 12 and opening the flappers 14 as they pivot around the activation ring 20. FIG. 19 shows a close up view of the valve assembly 1 with the actuating sleeve 61 in its operative position.

The actuating sleeve 61 is sufficiently long that some axial movement (which can be restricted to the length of the recess 63 in which the collet finger head 83 sits) during operation is permissible while still maintaining the flappers 14 in their open configuration. The collet head 83*h* will engage the in the recess 63 and prevent any further axial movement uphole under normal operating conditions.

Retraction of the actuating sleeve 61 optionally returns the flappers 14 to their closed positions, as the resilient force of the spring 12 pushes the valve housings 11 axially in the uphole direction, leading to the flappers 14 abutting the activation ring 20 and pivoting around to close.

Figure 23:
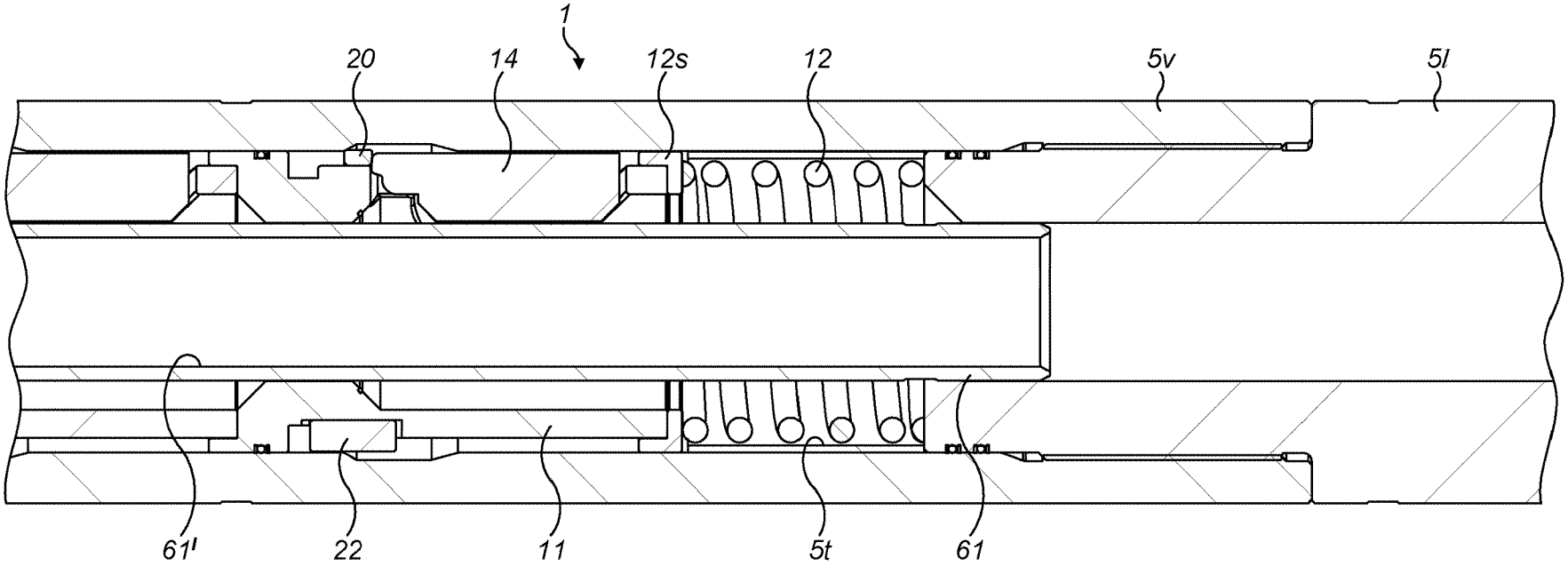
FIG. 23 shows a close up cross-sectional view of a part of the NRV tool in a configuration similar to FIG. 15, showing an optional internal travel stop.

FIG. 23 shows a modification of the arrangement shown in FIG. 15, in which the same reference numbers are used. In the FIG. 23 modification, the actuating sleeve 61' is longer than the actuation sleeve 61, and extends all the way through the flappers 14 and into the lower body 51 when the head 83*h* is engaged in the groove 63. This isolates the spring 12 in a cavity, helps to keep the flappers 14 in an open configuration, and helps to avoid snagging or damaging the flappers when tools are run into the hole. Also, the FIG. 23 arrangement includes a travel stop sleeve 5*t* surrounding the spring 12, which has a smaller diameter than the spring sleeve 12*s*, and limits its downward travel in the bore.

Optionally the valve assembly can be used in coring operations. Optionally the valve member is curved in order to optimise (e.g. minimise) radial wall thickness while retaining a throughbore of sufficient size to run and pull wireline retrievable core barrels through the tool. Optionally an actuator member is used to actuate the valve into an open configuration. Optionally the curved valve member maximises the throughbore inner diameter and thereby minimises flow velocities and associated body and seal erosion through the valve.

In such an example the valve is intended primarily for use as a coring downhole non-return valve, where the valve prevents backflow and also retains a pressure differential, for example in managed pressure drilling or underbalanced drilling situations, where wireline retrievable core barrels must be removed from the well when statically underbalanced drilling fluid is being used.

Optionally the shuttle device can also be used as part of a coring operation. Optionally in a coring application, an actuator member is run on wireline retrievable core barrel. This configuration of the apparatus utilises the core barrel running tool to transport the actuator member to the valve assembly, where passage of the actuator member through the valve assembly actuates the valve or valves into the open configuration.

Once the actuator member has passed sufficiently through the valve assembly in order to actuate the valve or valves to the open configuration, it is optionally locked into position, with axial movement prevented by the shuttle device.

Optionally the actuator member is held in said position while the core barrel running tool and wireline pass through to either collect or deposit a new core barrel.

When the running tool passes back through the actuator member during retraction of the tool from the wellbore, the actuator member is optionally collected as part of the retraction process. Removal of the actuator member from the valve assembly permits the valve assembly to return to its standard operating configuration.

Optionally, return of the valve assembly to its normal operating configuration allows pressure to be bled off above the valve for retrieval of the core barrel at surface.

In a wireline coring application the valve assembly is optimised to give a low differential pressure rating but maximising the diameter of the throughbore to allow a wireline conveyed core barrel to pass through the flapper valves. This can optionally allow a large enough bore diameter to allow wireline core barrels to be run or retrieved through the valve, which allows non return valves to be used as downhole safety valves during wireline coring operations and in managed pressure or underbalanced drilling operations. This represents an advancement in safety and environmental containment as it can help to prevent backflow of well fluids up the drillstring in such operations.

In coring operations, the flapper valve assembly can be run in the drillstring as part of the bottom hole assembly above the main coring assembly. When a core barrel is retrieved wireline is run with the core barrel retrieval assembly and the actuating sleeve 61 can be mounted on a running/retrieval tool immediately above the core barrel retrieval assembly. When the core barrel retrieval assembly reaches the flappers it forces them open mechanically (or optionally they can be opened by circulation down the drillpipe) and passes through them. Once the lock open or actuating sleeve 61 reaches its installed position with the head 83*h* in the groove 63, the sleeve 61 is released from its running tool on the wireline and locks into position holding the flappers in the open position as shown in FIG. 23. The wireline core retrieval assembly then optionally continues to run into the hole to retrieve the core barrel with the actuating sleeve 61 in place across the flappers 14 protecting the wire from being trapped or severed by the flappers 14, and protecting the flappers 14 from damage by the tool string.

When pulling out of hole with the core barrel the running/retrieval tool on the wireline assembly passes back through the actuating sleeve 61 and unlatches the actuating sleeve 61 from the valve assembly on the way back up. As the sleeve 61 is unlatched from the valve assembly it optionally locks back onto the running/retrieval tool. The remainder of the core barrel retrieval tool and core barrel is pulled through the flappers. During this process the flappers 14 are held open either mechanically by the core barrel retrieval tool or optionally by circulation down the drillpipe. Once the core barrel is retrieved through the flappers 14 circulation can be stopped and the flappers 14 will close preventing backflow in the drillpipe.

By using this arrangement a larger core barrel can be used below the lock open/actuating sleeve 61 (of greater diameter then the lock open sleeve 61 itself) and the wireline itself is protected from being caught or severed by the flappers 14 unintentionally closing upon it as it passes through the valve. The diameter of core barrel is then only limited by the inner bore diameter of the flapper housing 11.

Referring now to FIGS. 24-27, a second example of part of an NRV tool 100 in accordance with the invention is shown and comprises a valve assembly 101 and optionally an actuator assembly 150 essentially as described in the corresponding features above in relation to the first example, and therefore these are not described in detail in the second example, but the reader is referred to the above descriptions for details of these features.

In this second example, the valve assembly 101 and actuator assembly 150 are to be used in a drill string.

The NRV tool 100 is formed from a number of tubulars in the form of five body sections, these being a top sub 105*u*, a body section 105*a* in which the actuator assembly 150 is housed, a central or mid sub 105*c*, a body section 105*v* in which the valve assembly 101 is housed, and a bottom sub 105*l*.

The valve assembly 101 may be connected to a central or mid sub 105*c* when other components, for example the actuator assembly 150, are to be used during valve operations, or optionally the valve assembly 101 may alternatively be directly connected to a top sub in which case, the second example of the NRV tool 100 does not incorporate the actuator assembly 150.

Figure 24:
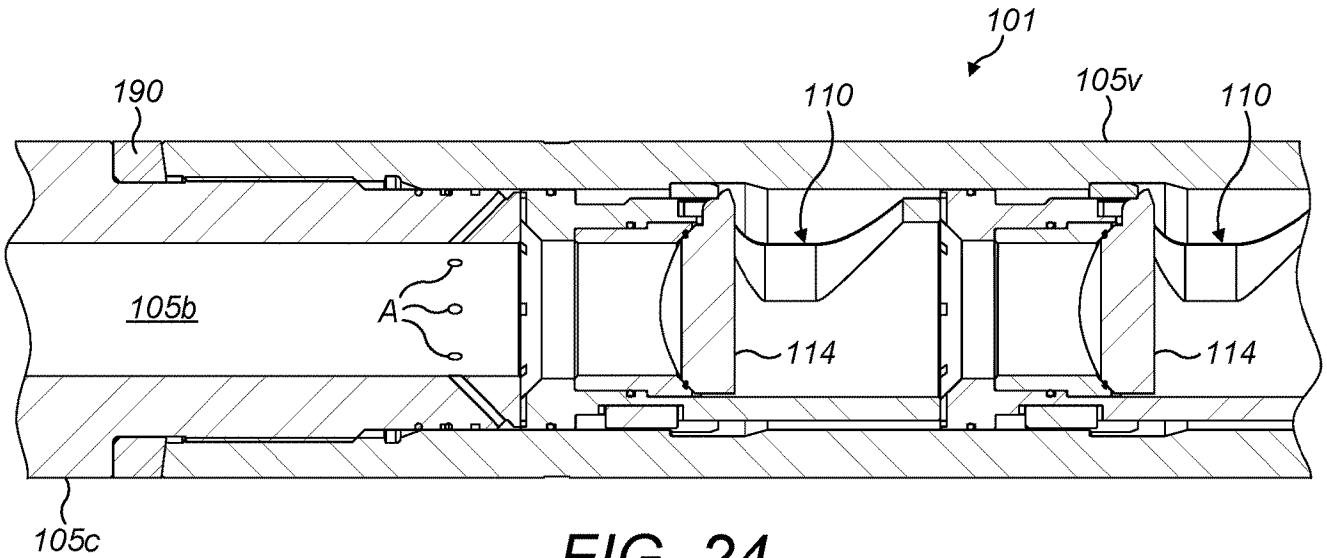
FIG. 24 shows a close-up schematic cross-sectional view of a part of a second example of a NRV tool incorporating a valve assembly in accordance with the present invention, where this second example differs from the first example of FIG. 11 by additionally having a first spacer device having a first thickness disposed between the valve assembly and the adjacent sub.
Figure 25:
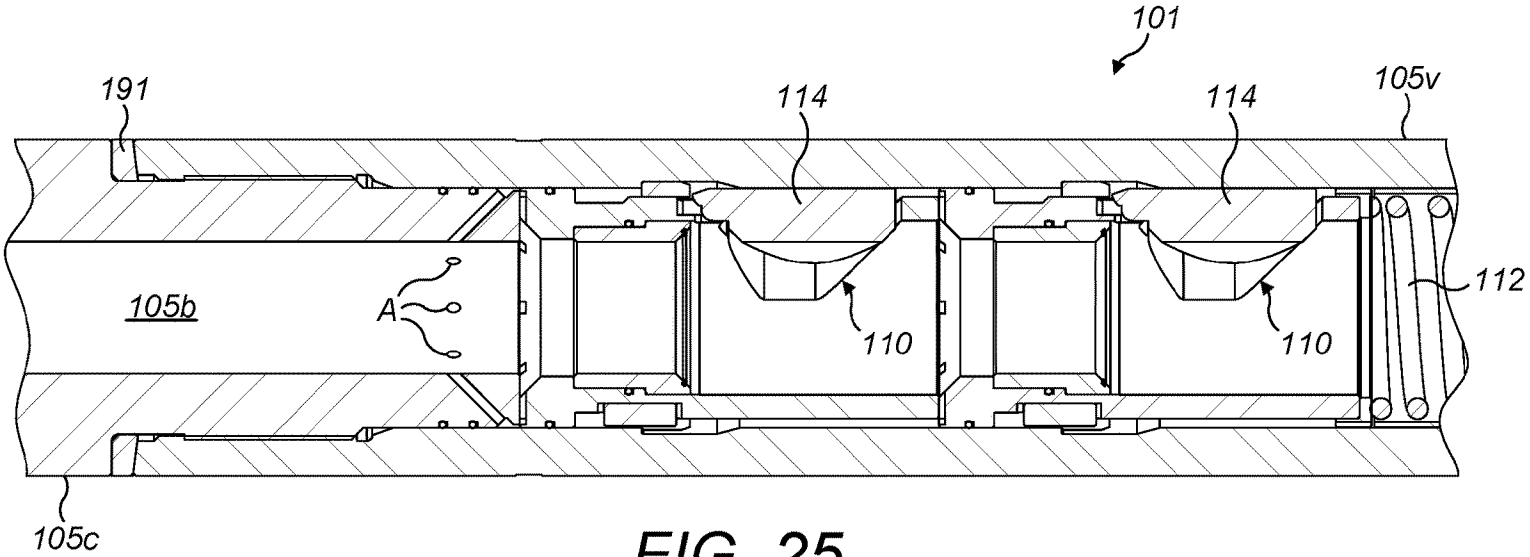
FIG. 25 shows a close-up schematic cross-sectional view of an example of the valve assembly of FIG. 24 but with a second spacer device having a second thickness disposed between the valve assembly and the adjacent sub.
Figure 26:
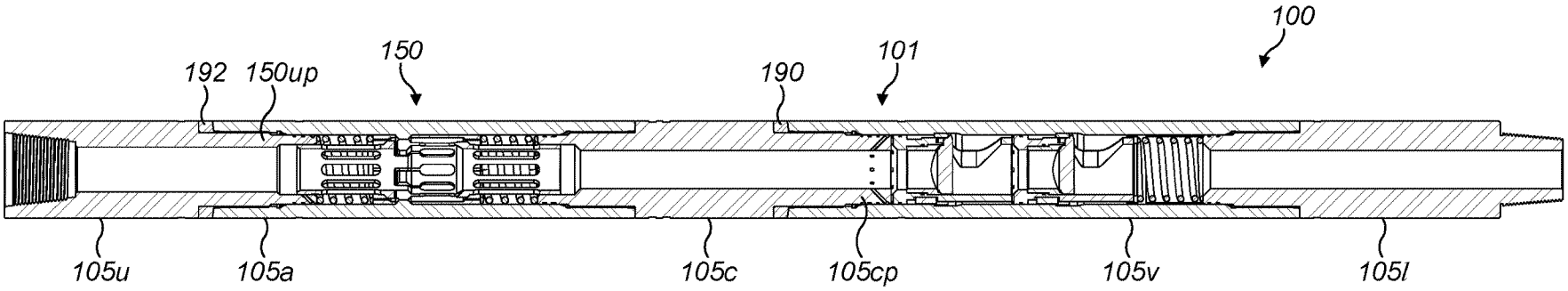
FIG. 26 shows an example of an NRV tool incorporating the actuator assembly and valve assembly of FIG. 24 having spacer devices of a first thickness disposed between subs and the valves closed.
Figure 27:
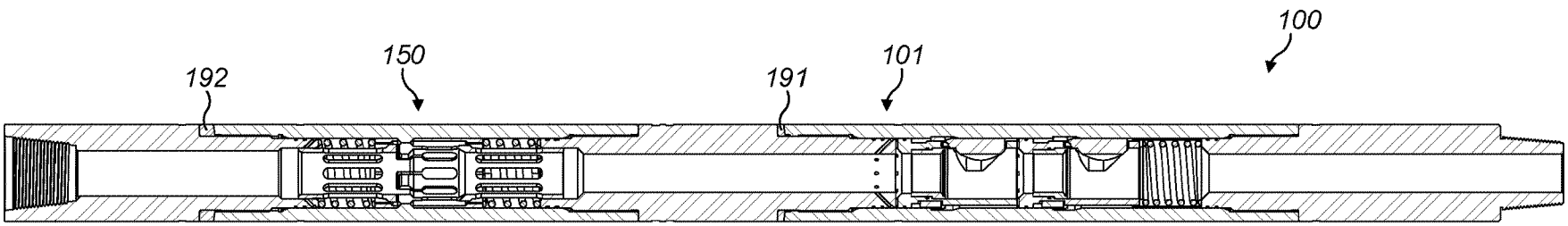
FIG. 27 shows the assemblies of FIG. 26 having a first and second spacer device having different thicknesses and the valves open.

FIG. 24 shows the valve assembly 101 in a closed configuration, with flappers 114 positioned such that fluid flow through the bore 105*b* is restricted. Apertures A provide a means of washing the uppermost end (left hand end as shown in FIG. 24) of the valve cartridges 110 to remove any debris that may prevent axial movement of the cartridges 110.

First spacer 190 is positioned between the uphole end of the valve assembly 101 and the downhole end of the mid sub 105*c*, such that the valve assembly 101 is axially spaced apart from the mid sub 105*c* by the thickness of the first spacer 190 which may be the required one inch thick. The valves 114 remain in the closed configuration once the connection between the mid sub 105*c* and the valve assembly 101 is torqued up.

During operational use, it may be that pressure builds up below the valves 114 and becomes trapped beneath them. This pressure must be bled off before, e.g., another drill stand may be added into the string below the bottom sub 105*l* of the valve assembly 101.

In one example of a method of pressure bleed-off using the present invention, the valves 114 are kept in their closed configuration and conventional pressure bleed-off apparatus is placed above the string. In one example, wireline pressure control equipment is placed above the uppermost end of the drill string (not shown), for example a stuffing box through which wireline passes, sealed so that pressure integrity in the drill string is not lost. A lock-open sleeve (described above as lock open/actuator sleeve 61) is connected to the end of the wireline and run into the drill string via the stuffing box and into the bore of the actuator assembly 150 during connection of the pressure control equipment to the string. Once the pressure control equipment is connected and seals are formed, the parts of the string above the still-closed valves 114 may be pressured up to balance the pressure differential between the string below the valves 114 and above the valves 114. The lock-open sleeve is then run further through the actuator assembly 150 and into the valve assembly 101 to open the valves 114 and release the trapped pressure into a bleed-off line, which may be connected to the drill string above the NRV tool 100 via a T-piece, or may be connected into the wireline pressure control equipment. Once the pressure has been sufficiently reduced, the lock-open sleeve (not shown in FIGS. 24 to 27) may be withdrawn, and the valves 114 return to their closed configuration, thereby maintaining pressure integrity in the string below the valves 114. The skilled reader will understand that this method of pressure bleed-off can also be used with the first example of the NRV tool of FIGS. 1 to 23 and indeed is the main method of pressure bleed-off for that example of NRV tool.

In another example of a pressure bleed-off method using an aspect of the present invention, the valve assembly 101 of FIGS. 24 to 27 is threadably connected to but axially spaced from a mid sub 105*c* by at least one first spacer 190 that is positioned between the pin connector of the mid sub 105*c* and the box connector of the valve assembly 101, so that when the connection is made up, the first spacer 190 separates the mid sub 105*c* from the valve assembly 101 by approximately 1 inch, although the spacing distance can change according to operational configurations and the relative sizes of the connectors, for example. The first spacer 190 provides a surface for the mid sub 105*c* to be torqued against to tighten the connection between the mid sub 105*c* and the valve assembly 101.

The first spacer 190 is in the form of two half-shells, and the two half-shells are placed in position between the mid sub 105*c* and the valve assembly 101 to form a full annular ring 190.

The first spacer 190 is tapered in cross-section, with its thickest cross-sectional point at its inner diameter; i.e., the spacer 190 reduces in thickness in a radial direction outwards from the spacer's 190 inner diameter. This resists radial movement of the spacer 190 relative to the sub 105*c* and the valve assembly 101, as the spacer 190 is effectively dovetailed into the connection and retained in position by the thicker inner portion. The spacer 190 has one flat (in use, uppermost) planar face that contacts the shoulder surface of the mid sub 105*c* at the end of the pin connector. The spacer 190 has an opposing face that is angled to form the tapered cross-section, where the angled face contacts the correspondingly angled end of the box connector on the valve assembly 101. Having at least one planar face allows the connection to be fully torqued as the mid sub 105*c* fully contacts the surface of the planar face of the spacer 190.

For normal valve operations, where the valves 114 are in the closed configuration, the spacer 190 has a first maximum thickness, for example one inch, wherein the axial dimension of each spacer is measured at an outer radius.

In another example of a pressure bleed-off method using an aspect of the present invention, the valve assembly 101 can be directly connected to a bottom sub 105*l* at its downhole end and a top sub (e.g. 105*u*; direct connection not shown) at its uphole end, i.e. the valve assembly 101 may be used independently of the actuator assembly 150, and the valve assembly 101 may then be placed into the drill string.

When pressure must be bled off the weight of the string is first supported (for example by slips), before the connection between the mid sub 105*c* and the valve assembly 101 is broken at a location above the valve assembly 101. The connection is broken by backing the connection out by one turn (optionally the connection between the top sub 105*u* and the valve assembly 101, where the valve assembly 101 is being used independently of the actuator assembly 150), which loosens the connection enough to remove the spacer 190. After removal of the spacer 190 the connection is tightened, for example by making up the connection by five turns, which brings the edges of the sub into contact with the edges of the valve assembly 101. The additional axial space freed up by removal of the spacer 190 allows the pin connector of the sub to axially travel further into the box connector of the valve assembly 101.

In situations where the actuator assembly 150 is omitted and the top sub 105*u* is connected directly to the valve assembly 101, as the pin connector of the top sub 105*u* travels axially into the box connector of the valve assembly 101 it engages the uppermost valve cartridge 110 adjacent to the box connector. As the pin connector of the top sub 105*u* continues to be threaded into the box it pushes the adjacent (uppermost) valve cartridge 110 in the same axial, downhole, direction. The axial movement of the valve cartridge 110 pivots the valve 114 around the pivot axis (described above as pivot axis 13) into an open configuration. The example of the valve assembly 101 shown in FIGS. 24-27 has two valve cartridges 110 connected in series. As the pin connector drives the adjacent first valve cartridge 110 axially downwards, the first (uppermost or left hand in FIG. 24) valve cartridge in turn drives the next (lowermost or right-hand in FIG. 24) valve cartridge, and both valves 114 pivot around their respective pivot axes into the open configuration. Accordingly, the skilled person will understand that both the mid sub 105*c* or the top sub 105*u* can be used in conjunction with the spacers 190, 191, 192 to open the valves 114 in this way. When the actuator assembly 150 is in place the mid sub 105*c* is used. When the actuator assembly 150 is not in place the top sub 105*u* can replace the mid sub 105*c* and can be used to change the configuration of the valves 114 in a similar manner to the mid sub 105*c*.

In order to ensure that the valves 114 are open prior to commencing bleed-off, mud is pumped through the valve assembly 101 to test the valve configuration. After the bleed-off procedure is completed, the valves 114 can be returned to the closed configuration, where flow of fluid is resisted by the valves 114 obturating the bore 105*b*. To return the valves 114 to the closed configuration, the connection is backed out by as many turns as were required to tighten the connection after the spacer 190 was removed, for example, five turns.

To maintain the operational status of the valves 114, spacer 190 may be replaced into the connection and the connection re-torqued against the surface of the spacer 190. This spaces the pin and box connections of the sub and the valve assembly 101 so that the valve cartridges 110 are not engaged by the pin connection, and the valves 114 may return to the closed configuration.

In an alternative aspect of the invention, after the connection has been backed out, a spacer 191 with a lesser maximal thickness than spacer 190, for example a spacer 191 with a maximal thickness of 0.4-0.5 inches, may be installed in the connection and the connection re-torqued. The reduced thickness of spacer 191 allows the pin connection to compress the spring 112 that biases the valve cartridges 110 in the uphole direction, thereby disengaging the spring 112 so that it no longer acts on the valve cartridges 110. The valves 114 then remain in the open configuration, falling in the downhole direction under the influence of gravity. The spacer 191 thus both permits torqueing up of the connection and prevents the spring 112 from acting on the valve assembly 101 to return the valves 114 to the closed configuration.

Where the NRV tool 100 comprises the actuator assembly 150 and the valve assembly 101, a one-inch thick (or other appropriate dimension) spacer 192 can be placed between the top sub 105*u* and the actuator assembly 150. The actuator assembly 150 is threadably connected to mid sub 105*c*, which is in turn connected to the valve assembly 101. A spacer 190 (FIG. 26), or a thinner spacer 191 (FIG. 27), can be placed between the mid sub 105*c* and the valve assembly 101 as described above.

Having the spacer 192 placed between the top sub 105*u* and the actuator assembly 150 means that the top sub 105*u* can be run straight into the valve assembly 101 if the actuator assembly 150 is removed.

In other words, the valve assembly 101 can be used with or without the actuator assembly 150. With the actuator assembly 150 in place there are 5 body sections: top sub 105*u*, actuator assembly housing 105*a*, mid sub 105*c*, valve assembly housing 105*v* and bottom sub 105*l*. When the actuator assembly 150 is used there are only 3 main body sections, top sub 105*u*, valve assembly housing 105*v* and bottom sub 105*l*. When the mid sub 105*c* and actuator assembly housing 105*a* are removed, the top sub 105*u* pin threads into the box connector that the mid sub 105*c* pin formerly fitted, and has an identical profile. In this way opening of the valves 114 can be achieved by the same method with either the mid sub 105*c* pin or the top sub 105*u* pin. For the lock open sleeve method of opening the valve, however, all 5 body sections are required.

The spacer 192 between the top sub 105*u* and the actuator assembly housing 105*a* acts to space out the axial length of the pin 105*up* on the top sub 105*u* from the actuator assembly housing 105*a*, and to permit torqueing up of the top sub 105*u*, as the mating faces of the top sub 105*u* and actuator assembly housing 105*a* are not parallel; instead the upper end face of the actuator assembly 105*a* has a dovetail profile and the lower end face of the top sub 105*u* has a flat (perpendicular to the long axis of the NRV tool 100) profile. As the actuator assembly 150 is optional, the top sub 105*u* may be interchanged with the mid sub 105*c* when the actuator assembly 150 (and therefore the actuator assembly housing 105*a*) is not required. This means that the overall axial length of the top sub pin 105*up* and its spacer 192 must be identical to the overall axial length of the mid sub pin 105*cp* and it's corresponding spacer 190.

Modifications and improvements may be made to the examples and embodiments hereinbefore described without departing from the scope of the invention.

The invention claimed is:

1. A non-return valve assembly for controlling fluid flow in a throughbore of a drill string in an oil, gas or water well, the non-return valve assembly comprising:

a body having an axis and being in fluid communication with the wellbore conduit, the body having suitable connections at opposite ends for inter-connection into a string of drill pipe tubulars, and at least one flapper valve disposed in a valve housing in the body, and a flapper seat wherein the flapper valve is pivotally coupled to the valve housing by a pivot axle and wherein the flapper valve is permitted to selectively seal against the flapper seat in order to close the throughbore of the drill string to prevent fluid passing therethrough;

wherein the valve housing, flapper valve and pivot axle are all adapted to move, with respect to the body, together axially within the body, and including a displacement mechanism which acts between the body and the valve housing and is adapted to apply axial force to urge the valve housing, the flapper valve and the pivot axle to move, with respect to the body, together axially within the body, wherein the non-return valve assembly further includes a flapper valve control member secured to and located within the body and being adapted to control axial movement of the valve housing, pivot axle and the flapper valve in the body;

and wherein the flapper valve is adapted to be actuated between an open configuration and a closed configuration by axial movement of the valve housing, together with the flapper valve and the pivot axle, with respect to the flapper valve control member, within the body, said axial movement being caused by said axial force applied by said displacement mechanism, wherein the flapper valve is adapted to be actuated into the open configuration by rotation of the flapper valve away from the flapper seat about the pivot axle in a first rotational direction such that fluid can flow through the throughbore of the drill string, and wherein the flapper valve is adapted to be actuated into the closed configuration by rotation of the flapper valve toward the flapper seat about the pivot axle in a second rotational direction, which is opposite to the first rotational direction, to seal against the flapper seat in order to prevent fluid flow through the throughbore of the drill string, wherein the flapper valve is adapted to be actuated into the open configuration by a pressure differential, arising from flow of fluid in the throughbore in an uphole to downhole direction, acting across the flapper valve, wherein the displacement mechanism is configured to urge the flapper valve against the flapper valve control member into the closed configuration;

wherein the flapper valve further comprises a plate extending from the pivot axis in one direction and a tang extending away from the pivot axis in the opposite direction, such that the tang is offset from the pivot axis of the flapper valve, and wherein a portion of the tang provides a point of contact between the flapper valve and the flapper valve control member such that there is provided an offset between the point of contact between the said portion of the tang of the flapper valve and the flapper valve control member, and the pivot axis of the flapper valve provided by the pivot axle, such that when the valve housing, the flapper valve and the pivot axle are moving axially together to move from the open configuration to the closed configuration due to said axial force being applied by said displacement mechanism, at least the said portion of the tang of the flapper valve is moved into contact with and thus abuts against the flapper valve control member and continued such axial movement causes the said portion of the tang to remain in contact with the flapper valve control member and also urges the flapper valve in rotation around the pivot axis, provided by the pivot axle, in the said second rotational direction as the valve housing, the flapper valve and the pivot axle slide axially relative to the flapper valve control member within the body; and wherein the offset comprises a radial offset, whereby inter-engaging portions of the flapper valve control member and flapper valve are radially spaced from the pivot axis provided by the pivot axle of the flapper valve.

2. A valve assembly as claimed in claim 1, wherein the flapper valve has at least one and optionally two non-planar faces formed in an arc extending at least partially around the axis of the bore.

3. A valve assembly as claimed in claim 1, wherein the valve housing and flapper valve form a cartridge that is received within the bore of the body, and which is removable from the bore of the body.

4. A valve assembly as claimed in claim 3, wherein two or more valve cartridges are connected in series in axial alignment within the bore of the body and each valve cartridge is modular and individually removable from other cartridges placed in series downhole from the cartridge to be removed.

5. A valve assembly as claimed in claim 1, wherein the flapper valve is pivotally coupled to the valve housing by a pivot axle formed as an integral part of one of the valve housing and the flapper valve.

6. A valve assembly as claimed in claim 5, wherein the integral pivot axle comprises a pair of cylindrical protrusions extending from opposing surfaces of one of the valve housing and the flapper valve and at least a portion of the axle is received within a recess in the form of at least one groove formed in the other of the valve housing and the flapper valve.

7. A valve assembly as claimed in claim 1, wherein the displacement mechanism is axially spaced from the valve housing.

8. A valve assembly as claimed in claim 1, wherein the displacement mechanism is axially aligned with the valve housing.

9. A valve assembly as claimed in claim 1, wherein the displacement mechanism is arranged in compression between the valve housing and a formation in the bore of the body, such that the displacement mechanism is configured to urge the valve housing axially within the bore of the body.

10. A valve assembly as claimed in claim 1, wherein at least a portion of the displacement mechanism is radially spaced from the throughbore of the conduit.

11. A valve assembly as claimed in claim 1, wherein at least a portion of the displacement mechanism is disposed outside of the fluid flowpath.

12. A valve assembly as claimed in claim 1, wherein the valve assembly comprises at least one seal bonded to one of the flapper valve and the valve housing, arranged to seal between the flapper seat of the valve housing and the flapper valve when the flapper valve is in the closed configuration.

13. A valve assembly as claimed in claim 1, wherein the valve assembly comprises a radial restriction extending radially into the bore of the valve housing such that the valve assembly comprises at least two cross-sectional areas acting together as a nozzle which creates a pressure differential during fluid flow through the valve housing such that there is a higher pressure on one side of the flapper valve relative to the other side of the flapper valve; wherein one cross-sectional area is sealed by an annular seal, and another cross-sectional area is formed by the flapper seat against which the flapper valve is adapted to seat when the valve assembly is in the closed configuration; and wherein the pressure differential across the flapper valve actuates the flapper valve between the open and closed configurations.

14. A valve assembly as claimed in claim 1, wherein the flapper valve control member comprises an activation ring extending at least partially circumferentially around the valve housing, and wherein the flapper valve control member selectively engages the flapper valve and controls its movement relative to the valve housing.

15. A valve assembly as claimed in claim 1, wherein the flapper valve control member is rotationally fixed relative to the flapper valve.

16. A valve assembly as claimed in claim 1, wherein the range of axial movement of the flapper valve control member within the body is limited by a shoulder on the valve body.

17. A valve assembly as claimed in claim 1, wherein a flat face on the tang engages a flat face on the flapper valve control member in both of the open and closed configurations, and wherein the flat faces are connected by a rounded corner on at least one of the flapper valve and the flapper valve control member.

18. A valve assembly as claimed in claim 17, wherein in the closed configuration, a flat face on the flapper valve control member engages a flat face on an offset tang of the flapper valve, and wherein a resilient spring of the displacement mechanism pushes the flat face on the tang of the flapper valve against the flat face of the flapper valve control member.

19. A valve assembly as claimed in claim 18, wherein during opening of the flapper valve, when the flapper valve is pivoting around the pivot axis of the flapper valve, the offset tang of the flapper valve remains in contact with the flapper valve control member.

20. A valve assembly as claimed in claim 1, wherein axial movement of the valve housing within the body to shift the valve assembly between closed and open configurations is driven by a fluid pressure differential across the flapper valve.

21. A valve assembly as claimed in claim 1, wherein axial movement of the valve housing is adapted to energise the displacement mechanism.

22. A valve assembly as claimed in claim 1, wherein axial travel of the valve housing is limited by a travel stop.

23. A valve assembly as claimed in claim 1, wherein the valve assembly is connected into a drill pipe tubular comprising at least two body sections, wherein one body section contains the valve assembly, wherein the body sections are axially spaced apart by at least one selectively removable spacer device that is disposed between end surfaces of the said body sections.

24. A valve assembly as claimed in claim 1, further comprising an actuator assembly updated to change the actuation status of the valve assembly, the actuator assembly comprising a body, an actuator member adapted to change configurations in the body to change an actuation status of the valve assembly, and a shuttle device adapted to retain the actuator member in different configurations in the body; wherein the shuttle device is adapted to change configurations within the body relative to the actuator member, and has a detent mechanism adapted to engage the actuator member in a first configuration of the shuttle device and the actuator member to restrain movement of the actuator member within the body, and wherein in a second configuration of the shuttle device and the actuator member the detent mechanism permits movement of the actuator member within the body to actuate the valve assembly, and wherein the shuttle device has a return mechanism adapted to urge the shuttle device into the first configuration.

25. A method of control of fluid flow in a throughbore of a drill string in an oil, gas or water well, the method including flowing the fluid through a non-return valve assembly disposed in a body being in fluid communication with the drill string, the body having suitable connections at opposite ends for inter-connection into the drill pipe string of tubulars, the non-return valve assembly comprising at least one flapper valve disposed in a valve housing, and a flapper seat wherein the flapper valve is pivotally coupled to the valve housing by a pivot axle and wherein the flapper valve is permitted to selectively seal against the flapper seat in order to close the throughbore of the drill string to prevent fluid passing therethrough, wherein the valve housing, flapper valve and pivot axle are all axially movable with respect to the body, and wherein a displacement mechanism which acts between the body and the valve housing, is configured to apply axial force to urge the valve housing, the flapper valve and the pivot axle to move together in an axial direction with respect to the body and wherein the displacement mechanism is configured to urge the flapper valve into the closed configuration, wherein axial movement of the valve housing, the flapper valve and the pivot axle with respect to the body actuates the flapper valve between an open configuration and a closed configuration, wherein the non-return valve assembly further includes a flapper valve control member secured to and located within the body and being adapted to control axial movement of the valve housing, pivot axle and the flapper valve in the body, said axial movement being caused by said axial force applied by said displacement mechanism;

wherein the flapper valve is actuated into the open configuration by rotation of the flapper valve away from the flapper seat about the pivot axle in a first rotational direction such that fluid can flow through the throughbore of the drill string, and wherein the flapper valve is actuated into the closed configuration by rotation of the flapper valve toward the flapper seat about the pivot axle in a second rotational direction, which is opposite to the first rotational direction, to seal against the flapper seat in order to prevent fluid flow through the throughbore of the drill string, wherein the flapper valve further comprises a plate extending from the pivot axis in one direction and a tang extending away from the pivot axis in the opposite direction, such that the tang is offset from the pivot axis of the flapper valve, and wherein a portion of the tang provides a point of contact between the flapper valve and the flapper valve control member such that there is provided an offset between the point of contact between the said portion of the tang of the flapper valve and the flapper valve control member, and the pivot axis of the flapper valve, such that when the flapper valve is moved from the open configuration to the closed configuration due to said axial force being applied by said displacement mechanism, at least the said portion of the tang of the flapper valve is moved into contact with and thus abuts against the flapper valve control member and continued such axial movement causes the said portion of the tang to remain in contact with the flapper valve control member and also urges the flapper valve in rotation around the pivot axis provided by the pivot axle in the said second rotational direction as the valve housing, the flapper valve and the pivot axle slide axially relative to the flapper valve control member within the body;

wherein the offset comprises a radial offset, whereby inter-engaging portions of the flapper valve control member and the said portion of the tang of the flapper valve are radially spaced from the pivot axis provided by the pivot axle of the flapper valve;

and wherein the flapper valve is adapted to be opened by a pressure differential, arising from flow of fluid in the throughbore in an uphole to downhole direction, acting across the flapper valve.

* * * * *